US009714798B2

(12) United States Patent
Kinder et al.

(10) Patent No.: US 9,714,798 B2
(45) Date of Patent: Jul. 25, 2017

(54) HEAT EXCHANGER WITH RESILIENTLY MOUNTED BRACKET

(75) Inventors: Lee M. Kinder, Oakville (CA); Michael Bardeleben, Oakville (CA); Sachin Bhatia, Mississauga (CA)

(73) Assignee: Dana Canada Corporation, Oakville, Ontario (CA)

( * ) Notice: Subject to any disclaimer, the term of this patent is extended or adjusted under 35 U.S.C. 154(b) by 649 days.

(21) Appl. No.: 13/440,064

(22) Filed: Apr. 5, 2012

(65) Prior Publication Data

US 2012/0255709 A1 Oct. 11, 2012

Related U.S. Application Data

(60) Provisional application No. 61/472,853, filed on Apr. 7, 2011.

(51) Int. Cl.

| | |
|---|---|
| ***F28F 9/007*** | (2006.01) |
| ***F28F 9/00*** | (2006.01) |
| ***F28D 1/03*** | (2006.01) |
| *F28D 21/00* | (2006.01) |

(52) U.S. Cl.

CPC ..... *F28F 9/002* (2013.01); *F28D 1/0341* (2013.01); *F28F 9/0075* (2013.01); *F28D 2021/0082* (2013.01); *F28F 2265/26* (2013.01); *F28F 2265/30* (2013.01); *F28F 2275/143* (2013.01)

(58) Field of Classification Search

CPC ..... F28F 3/00; F28F 9/007; F28F 9/26; F28F 3/12; F28F 9/00; F28D 15/00; F24H 3/00; F24H 3/08; F24C 15/00; B60K 11/04

USPC ..... 165/67, 69, 149, 153, 81, 82

See application file for complete search history.

(56) References Cited

U.S. PATENT DOCUMENTS

| | | | | |
|---|---|---|---|---|
| 1,693,234 | A * | 11/1928 | Higgins | F01P 11/0214 180/68.4 |
| 1,699,826 | A * | 1/1929 | Witte | B60K 11/04 180/68.4 |
| 2,383,292 | A | 8/1945 | Dalzell et al. | |
| 3,447,602 | A * | 6/1969 | Dalin | 165/145 |
| 3,820,526 | A * | 6/1974 | Van Vliet | 126/110 R |
| 4,191,244 | A * | 3/1980 | Keske | F28F 9/06 165/144 |
| 4,355,780 | A * | 10/1982 | Bridgnell | F16F 15/06 248/675 |
| 4,519,467 | A * | 5/1985 | Saunders | 180/68.4 |

(Continued)

FOREIGN PATENT DOCUMENTS

| | | |
|---|---|---|
| GB | 1429298 A | 3/1976 |
| GB | 2235040 A | 2/1991 |

*Primary Examiner* — Len Tran
*Assistant Examiner* — Gustavo Hincapie Serna
(74) *Attorney, Agent, or Firm* — Marshall & Melhorn, LLC

(57) ABSTRACT

A heat exchanger comprises an end mounting arrangement including a mounting bracket having a first portion for attachment to a support structure and a second portion attached to the heat exchanger. A projection rigidly attached to the end of the heat exchanger is resiliently received in an aperture in the second portion of the mounting bracket. The projection may comprise a pin extending from a plate pair of the heat exchanger, and one end of the pin may be secured between the plates of the plate pair. The mounting bracket may be metal with a resilient element such as a rubber grommet provided in each aperture, or the bracket may comprise plastic in which case a grommet may not be required.

14 Claims, 20 Drawing Sheets

(56) References Cited

U.S. PATENT DOCUMENTS

| | | | | |
|---|---|---|---|---|
| 4,574,876 | A * | 3/1986 | Aid | 165/46 |
| 5,123,480 | A * | 6/1992 | Dixit | 165/104.16 |
| 5,137,080 | A * | 8/1992 | Haasch et al. | 165/78 |
| 5,447,192 | A * | 9/1995 | Woerner et al. | 165/81 |
| 5,544,714 | A | 8/1996 | May et al. | |
| 6,029,345 | A * | 2/2000 | Christensen | 29/888.01 |
| 6,332,495 | B1 * | 12/2001 | Jamison et al. | 165/153 |
| 6,390,180 | B1 * | 5/2002 | Olsen | 165/67 |
| 6,513,579 | B1 * | 2/2003 | Kent et al. | 165/67 |
| 6,675,921 | B2 | 1/2004 | Brown | |
| 6,691,767 | B2 | 2/2004 | Southwick et al. | |
| 6,732,728 | B2 * | 5/2004 | Hill et al. | 126/110 R |
| 6,742,572 | B2 | 6/2004 | Muhammad et al. | |
| 6,848,498 | B2 * | 2/2005 | Seki et al. | 165/80.1 |
| 6,851,469 | B2 * | 2/2005 | Sears et al. | 165/170 |
| 7,051,789 | B2 | 5/2006 | Sheppard | |
| 7,117,926 | B2 | 10/2006 | Mori et al. | |
| 7,302,997 | B2 | 12/2007 | Kozdras et al. | |
| 7,320,358 | B2 | 1/2008 | Kaspar et al. | |
| 7,367,379 | B2 | 5/2008 | Heine | |
| 8,011,631 | B2 * | 9/2011 | Kollar et al. | 248/232 |
| 8,056,553 | B2 * | 11/2011 | Khan | 126/116 R |
| 8,667,683 | B1 * | 3/2014 | Thomas et al. | 29/890.03 |
| 2002/0014326 | A1 * | 2/2002 | Nakado et al. | 165/153 |
| 2005/0236140 | A1 * | 10/2005 | Sheppard | 165/67 |
| 2006/0054306 | A1 * | 3/2006 | Kent | F28F 9/002 165/67 |
| 2007/0017657 | A1 * | 1/2007 | Iwasaki et al. | 165/67 |
| 2007/0119564 | A1 * | 5/2007 | Contet | F28D 1/0435 165/67 |
| 2007/0246207 | A1 * | 10/2007 | Nakamura | F28D 7/1684 165/173 |
| 2007/0246280 | A1 * | 10/2007 | Maeda et al. | 180/68.4 |
| 2011/0067837 | A1 * | 3/2011 | Schatz et al. | 165/69 |
| 2011/0146944 | A1 * | 6/2011 | Hand et al. | 165/47 |
| 2011/0240257 | A1 | 10/2011 | Piggott et al. | |
| 2011/0240387 | A1 | 10/2011 | Piggott | |
| 2012/0118532 | A1 * | 5/2012 | Jentzsch | F28F 9/002 165/67 |

* cited by examiner 62
64
68
58
60
68
70
14A
18A
80
66
80
20
18A
51

14A
18A
18A
20
51
86
86
66A
66B
88
62
64
68
68
58
60
70

HEAT EXCHANGER WITH RESILIENTLY MOUNTED BRACKET

CROSS-REFERENCE TO RELATED APPLICATION

This application claims priority to and the benefit of U.S. Provisional Patent Application No. 61/472,853 filed Apr. 7, 2011, the contents of which are incorporated herein by reference.

FIELD OF THE INVENTION

The invention generally relates to mounting arrangements for heat exchangers, and particularly to resilient mounting arrangements to minimize or avoid thermal stresses in heat exchangers.

BACKGROUND OF THE INVENTION

Heat exchangers for vehicles are typically rigidly mounted to vehicle components in order to prevent excessive movement and vibration. For example, many heat exchangers are provided with mounting brackets for connection of the heat exchanger to a housing or to another vehicle component. Rigid mounting can, however, constrain thermal expansion of the heat exchanger relative to the structure to which it is mounted, and this can cause thermal stresses in the heat exchanger. Over time, these thermal stresses can lead to premature failure of the heat exchanger.

Thermal stresses can be of particular concern in heat exchangers constructed from elongate tubes or elongate plates, in which stresses caused by longitudinal expansion of the tubes or plates can be significant.

There remains a need for mounting arrangements which reduce or avoid the damaging effects of thermal stresses caused by thermal expansion of heat exchangers, while at the same time avoiding excessive vibration of the heat exchanger.

SUMMARY OF THE INVENTION

In one aspect, there is provided a heat exchanger comprising: (a) at least one elongate flow passage defining a longitudinal axis; (b) a first mounting arrangement for attaching the heat exchanger to a support structure; (c) a second mounting arrangement for attaching the heat exchanger to the support structure, wherein the first and second mounting arrangements are spaced apart along the longitudinal axis, and wherein the second mounting arrangement comprises: (i) a mounting bracket having a first portion for attachment to the support structure and a second portion through which the mounting bracket is attached to the heat exchanger; (ii) at least one aperture provided in the second portion of the mounting bracket; (iii) at least one projection rigidly attached to the heat exchanger and projecting therefrom, each said projection attached to the second portion of the mounting bracket by a resilient connection and with its first end received in one of said apertures.

In another aspect, the first and second mounting arrangements are located proximate to opposite ends of said heat exchanger.

In another aspect, the first mounting arrangement is rigidly connected to the heat exchanger.

In yet another aspect, the first mounting arrangement comprises a mounting bracket having an apertured flange for connection to the support structure.

In yet another aspect, the heat exchanger further comprises a third mounting arrangement for attaching the heat exchanger to a support structure, wherein the first and third mounting arrangements each comprise a mounting bracket having an aperture flange for connection to the support structure, and wherein the first and third mounting arrangements are both located adjacent to a first end of the heat exchanger, and both are spaced from the second mounting arrangement.

In yet another aspect, the support structure comprises a heat exchanger housing.

In yet another aspect, the heat exchanger is a gas-liquid heat exchanger and comprises a plurality of said flow passages, and wherein said flow passages are for flow of a liquid coolant.

In yet another aspect, the heat exchanger has an end face to which the second portion of the mounting bracket is mounted, and wherein the second portion of the mounting bracket is spaced from the end face of the heat exchanger.

In yet another aspect, the second portion of the mounting bracket comprises a plate portion which is oriented substantially transverse to the longitudinal axis and the projections are oriented substantially parallel to the longitudinal axis.

In yet another aspect, each of said projections comprises a pin.

In yet another aspect, said second mounting arrangement further comprises at least one resilient annular grommet having a substantially cylindrical outer surface and a substantially cylindrical inner surface, and wherein each said resilient annular grommet provides said resilient connection between said one of said projections and the second portion of the mounting bracket.

In yet another aspect, each of the projections comprises a substantially cylindrical pin having a circumferential groove proximate to its first end, and wherein the inner surface of each said grommet has a circumferential rib which is received inside the circumferential groove of the pin.

In yet another aspect, the outer surface of each said grommet has a circumferential groove in which an edge portion of one of said apertures is received.

In yet another aspect, the circumferential groove of each said grommet is spaced from both ends of the outer surface thereof, such that the grommet has an outer portion extending from the aperture in a direction away from the heat exchanger, and an inner portion extending from the aperture in a direction toward the heat exchanger.

In yet another aspect, a small clearance gap is provided between the heat exchanger and the inner portion of the grommet.

In yet another aspect, the heat exchanger comprises a plurality of plate pairs, each said plate pair comprising a pair of plates joined together in face-to-face relation at peripheral edges of the plate pair, wherein one of said flow passages are defined inward of the peripheral edges, between the plates of each said plate pair, and wherein each of said projections extend along said axis from one of said peripheral edges of one of said plate pairs.

In yet another aspect, each of said projections comprises a pin which is rigidly secured to one of said peripheral edges of one of said plate pairs.

In yet another aspect, each said peripheral edge to which one of said projections is secured is provided with an aperture into which a second end of the pin is received, said aperture being spaced from the flow passage.

In yet another aspect, each said aperture in the peripheral edge is formed by providing both plates of the plate pair with bulges which combine to form said aperture when the plates are joined together.

In yet another aspect, each said pin is substantially cylindrical and wherein said aperture in the peripheral edge is substantially cylindrical and is formed by two of said bulges having a substantially semi-circular cross section.

In yet another aspect, the heat exchanger further comprises an inlet fitting and an outlet fitting, the fittings projecting from an end of the heat exchanger opposite to an end at which the second mounting arrangement is located.

In yet another aspect, the inlet and outlet fittings project from a first peripheral edge of one of said plate pairs, and wherein each of said projections extend from an opposite second peripheral edge of one of said plate pair, and wherein said first and second peripheral edges are spaced apart along the longitudinal axis.

In yet another aspect, adjacent plate pairs are spaced apart from one another by cooling fins provided between the flow passages of adjacent plate pairs, and wherein gaps are formed between the peripheral edges of adjacent plate pairs, and wherein the mounting bracket of the second mounting arrangement further comprises a third portion comprising a comb arrangement, wherein the comb arrangement comprises a plurality of spaced-apart teeth, wherein each of the teeth extends into, and substantially completely fills, one of said gaps between two of said plate pairs.

In yet another aspect, said comb arrangement is located along an edge of the second portion of the mounting arrangement, and projects therefrom at an angle of about 90 degrees toward said heat exchanger.

In yet another aspect, the first portion of the mounting bracket comprises an apertured flange.

In yet another aspect, the first portion of the mounting bracket is located along an edge of the second portion, and projects therefrom at an angle of about 90 degrees away from said heat exchanger.

In yet another aspect, said second mounting arrangement further comprises at least one plastic bushing, wherein each said bushing surrounds an inner edge of one of said apertures and has an interior surface sized to closely receive one of said projections, such that each said bushing provides said resilient connection between one of said projections and the second portion of the mounting bracket.

In yet another aspect, said mounting bracket is comprised of metal or plastic and each said plastic bushing is closely received in one of said apertures.

In yet another aspect, said mounting bracket is comprised of plastic and said plastic bushing is integrally formed as part of said mounting bracket.

BRIEF DESCRIPTION OF THE DRAWINGS

The invention will now be described, by way of example only, with reference to the accompanying drawings in which.

DETAILED DESCRIPTION

Figure 1A:
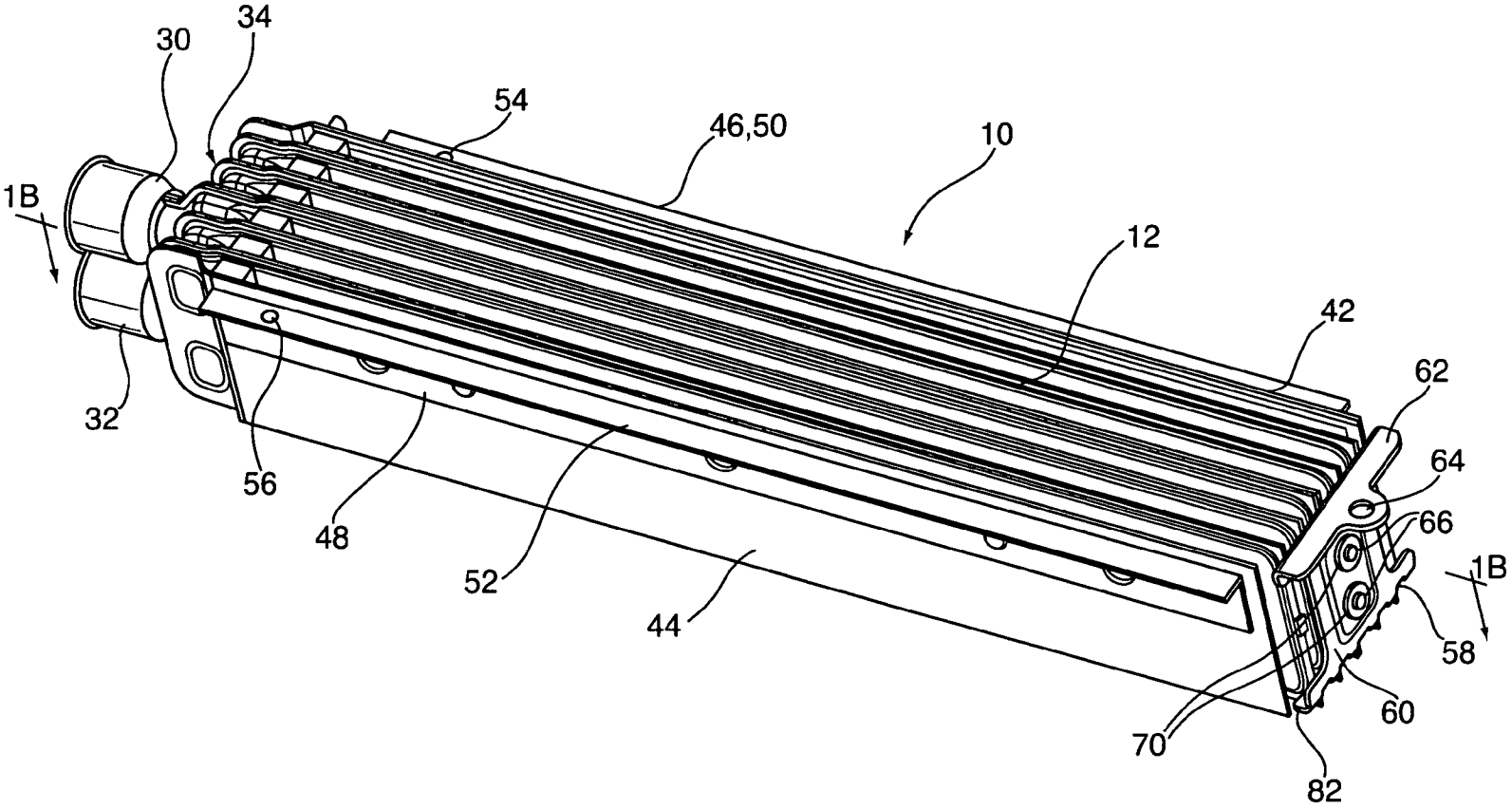
FIG. 1A is a perspective view of a heat exchanger according to an embodiment of the invention.

Illustrated in the drawings is a gas-liquid heat exchanger 10 for cooling compressed charge air in a supercharged or turbocharged internal combustion engine, or in a fuel cell engine. The heat exchanger 10 shown in the drawings is particularly configured for use in a supercharged internal combustion engine and has a relatively elongate, rectangular shape to supply intake air to a row of cylinders in the engine. This heat exchanger 10 is intended to be enclosed within a housing (not shown) and is located in an air flow path between an air compressor (not shown) and the intake manifold of the engine (not shown).

The heat exchanger 10 is of the plate and fin type, and has a core 12 comprising a plurality of plate pairs 14 arranged in a stack, with cooling fins (not shown) being provided in air flow passages 19 between adjacent plate pairs 14.

Figure 1B:
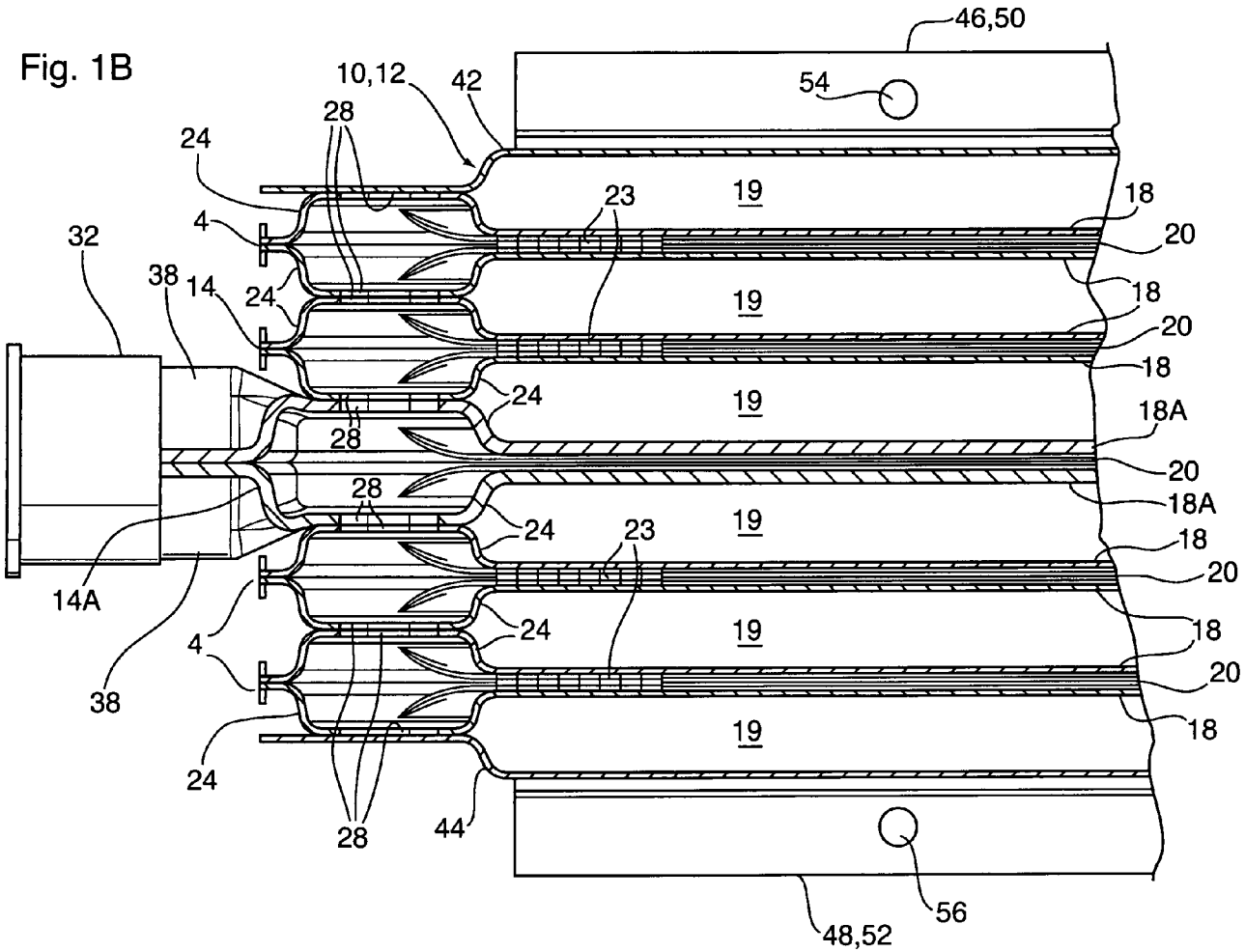
FIG. 1B is a partial longitudinal cross section along line 1B-1B of FIG. 1A

The plates 18 making up each plate pair 14 are joined together in face-to-face relation at their peripheral edges, for example by brazing. The central portions of the plates 18 are raised relative to the peripheral edges, such that each plate pair 14 defines an internal coolant flow passage 20 through which a liquid coolant flows between an inlet opening and an outlet opening. The coolant flow passages 20 may be provided with turbulence-enhancing inserts such as turbulizers 23, shown in FIG. 1B.

In this particular plate configuration, the coolant flow passage 20 is U-shaped and each plate 18 has a pair of raised, apertured bosses 22, 24 adjacent to one another at the one end of the plate pair 14. When the plate pairs 14 are assembled and are stacked to form the core 12, the raised bosses 22, 24 of adjacent plate pairs 14 are joined together, for example by brazing, so as to provide inlet and outlet manifolds which permit distribution of the coolant throughout the height of the heat exchanger core 12. Thus, the apertures in the raised bosses of the plates are referred to herein as inlet manifold openings 26 and outlet manifold openings 28, respectively.

It will be appreciated that other plate configurations are possible, for example the inlet and outlet manifold openings 26, 28 and associated bosses 22, 24 may be located at opposite ends of the plate pairs 14, with the coolant flow passage 20 comprising a single channel extending along the length of the plate pair 14.

The heat exchanger core 12 is also provided with inlet and outlet fittings 30, 32 which communicate with the respective inlet and outlet manifolds. In the heat exchanger 10 shown in the drawings, the fittings 30, 32 extend out from one end of the core 12, and this end is sometimes referred to herein as the "fitting end" 34. There are numerous ways to attach fittings 30, 32 to the end 34 of the core 12 of a plate and fin heat exchanger 10. In the present embodiment, the fittings 30, 32 are both attached to the edge of one of the plate pair 14A which is located approximately in the middle of the core 12. This is accomplished by providing each plate 18A in this plate pair 14A with a pair of semi-circular bulges 36, 38 at its edge, each bulge 36, 38 forming one-half of a coolant inlet or outlet opening 40. These bulges 36, 38 are in flow communication with the respective raised bosses 22, 24 in which the respective manifold openings 26, 28 are provided, thereby providing flow communication between the inlet and outlet fittings 30, 32 and the respective manifolds. Although the fittings 30, 32 in the illustrated heat exchanger 10 extend from an end 34 of the core 12, it will be appreciated that the fittings may instead be provided at the sides of the core 12. Also, although both fittings 30, 32 extend from the edge of a single plate pair 14A, it is possible to provide the inlet and outlet openings 38, 40 and the fittings 30, 32 in different plate pairs 14.

The ends of the heat exchanger core 12 are provided with top and bottom plates 42, 44 which close the manifold openings 26, 28 of the two endmost plate pairs 14, and which provide surfaces to which mounting brackets may be secured. In the illustrated embodiment, each plate 42, 44 is provided with a respective top or bottom mounting bracket 46, 48. Each mounting bracket 46, 48 includes a vertical plate portion which is secured to the side plate, for example by brazing, and an outwardly extending flange 50, 52 for mounting the heat exchanger 10 within the housing (not shown). Each of the flanges 50, 52 is provided with an aperture 54, 56 through which the heat exchanger 10 is rigidly secured to the housing, for example by bolts (not shown). The apertures 54, 56 in the top and bottom brackets 46, 48 are both located adjacent the fitting end 34 of the heat exchanger 10, and serve to rigidly mount the fitting end 34 of the heat exchanger 10 within the housing.

The end of the heat exchanger 10 opposite to the fitting end 34 is provided with an end mounting bracket for mounting the heat exchanger 10 within the housing. The end mounting bracket 58 includes a vertical plate portion 60 which is mounted to the heat exchanger core 12. At the upper edge of the plate portion 60 is an outwardly extending flange 62 having an aperture 64 through which the end mounting bracket 58 is rigidly secured to the housing by a fastener such as a bolt (not shown). The end mounting bracket 58 according to this embodiment is typically made from metal.

It will be appreciated that rigid mounting of the end mounting bracket 58 to the heat exchanger core 12 would constrain longitudinal thermal expansion of the core 12 between the end mounting bracket 58 and the two mounting points adjacent to the fitting end 34, and this could result in damaging thermal stresses. In order to minimize or avoid these stresses, the end mounting bracket 58 is resiliently mounted to the heat exchanger core 12 by the arrangement described below. On the other hand, the elimination of a mounting point at this end of the core 12 would permit free longitudinal expansion of the core 12, but could potentially increase vibration, which may also have a damaging effect on the heat exchanger 10.

The end bracket mounting arrangement shown in the drawings comprises one or more bracket mounting pins 66 which are rigidly secured to the heat exchanger core 12. The pins 66 extend into apertures 68 provided in the plate portion 60 of the end mounting bracket 58. In the embodiment shown in the drawings, the mounting arrangement comprises two bracket mounting pins 66 and two apertures 68 provided in the end mounting bracket 58. It will, however, be appreciated that the mounting arrangement may include any number of pins 66 and corresponding apertures 68 necessary for secure attachment of the bracket 58 to the core 12. Although the illustrated embodiment utilizes cylindrical mounting pins 66 to secure the end mounting bracket 58, this is not necessarily the case. Rather, the mounting arrangement can utilize various types of projections extending from the heat exchanger, whether they are pins or other structures. Furthermore, the pins or other projections are not necessarily cylindrical, but may have other cross-sectional shapes, such as oval or polygonal, wherein polygonal shapes include triangular, rectangular, square, pentagonal, hexagonal, etc. Furthermore, the projections may be secured to the heat exchanger or may be integrally formed therewith.

The illustrated mounting arrangement further comprises a pair of grommets 70, each of which is received in one of the apertures 68 in the end mounting bracket 58 and surrounds one of the bracket mounting pins 66. The grommets 70 are annular, having a substantially cylindrical inner surface and a substantially cylindrical outer surface. The inner surface may be provided with an annular rib 72 which seats inside an annular groove 74 provided in the bracket mounting pin 66. This rib and groove arrangement provides retention of the grommet 70 on the pin 66 and ensures proper bracket alignment. As shown, the pins 66 may be provided with grooves 74 at both ends to avoid manufacturing errors whereby a pin 66 is secured backwards to the core 12.

Figure 3:
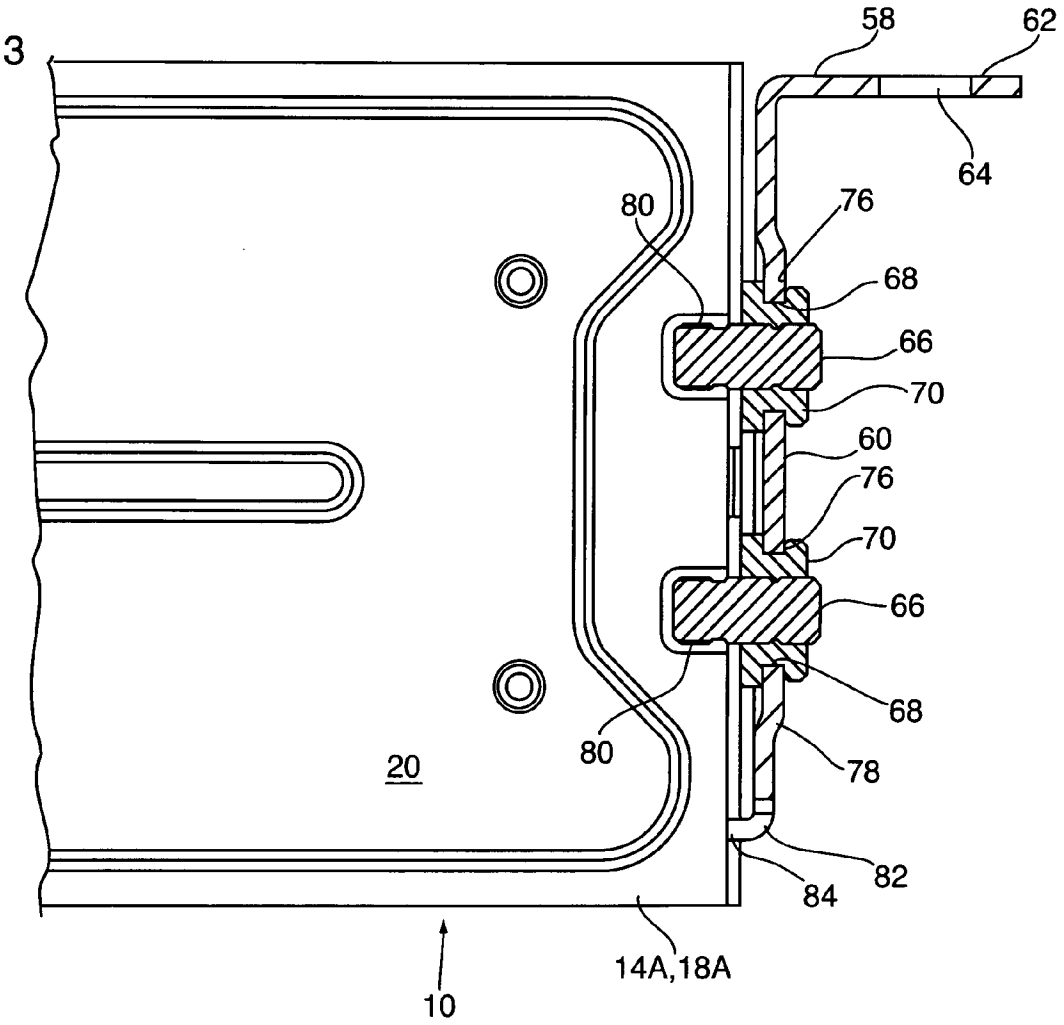
FIG. 3 is a cross-section through the heat exchanger of FIG. 1A, the section being taken along a longitudinal plane bisecting the end mounting bracket and its mounting arrangement.
Figure 4:
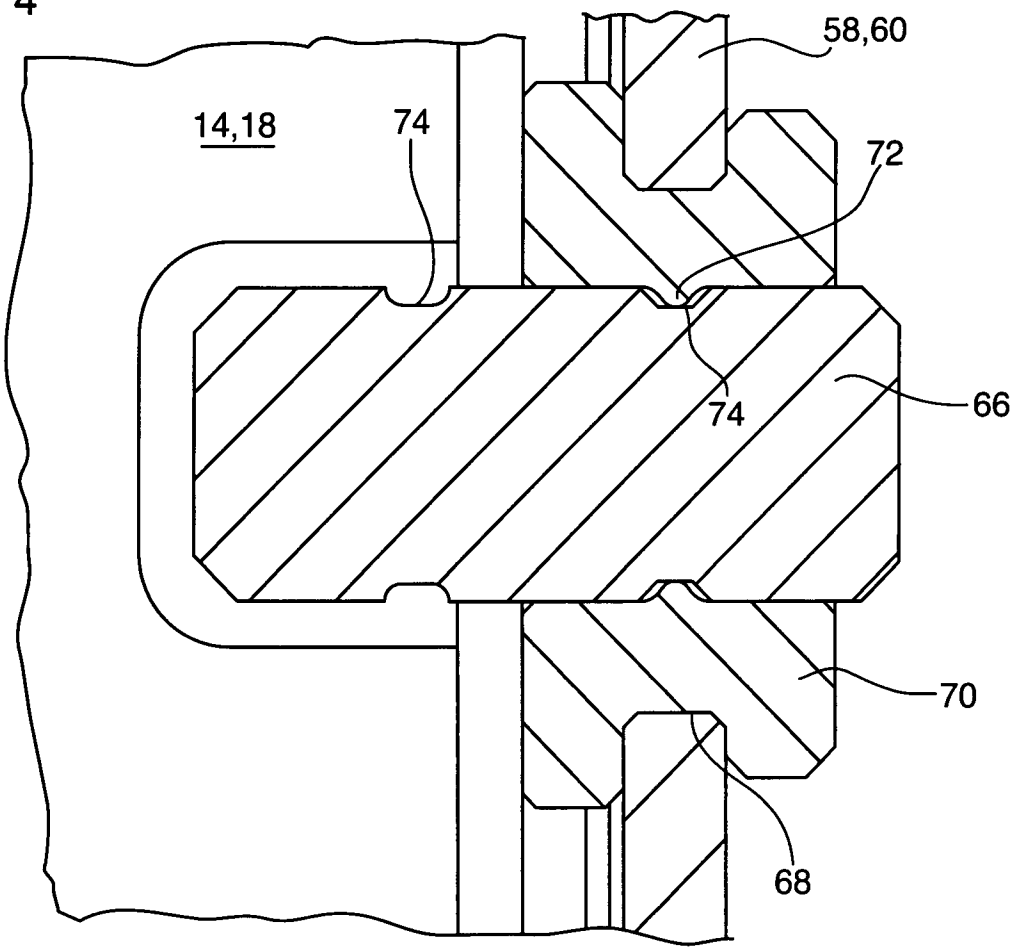
FIG. 4 is an enlargement of a portion of FIG. 3, showing a portion of the mounting arrangement in more detail.
Figure 5:
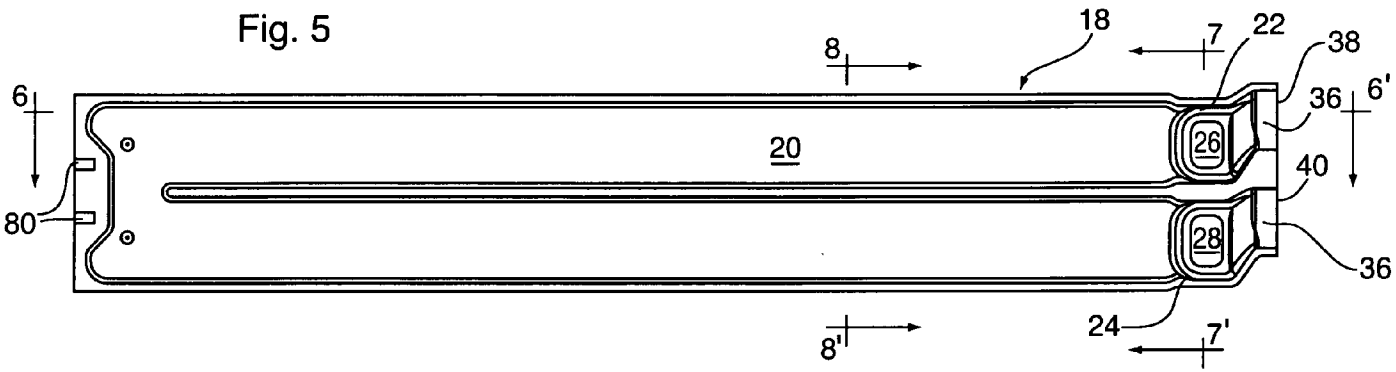
FIG. 5 is a plan view of a heat exchanger plate of the heat exchanger of FIG. 1A.
Figure 6:
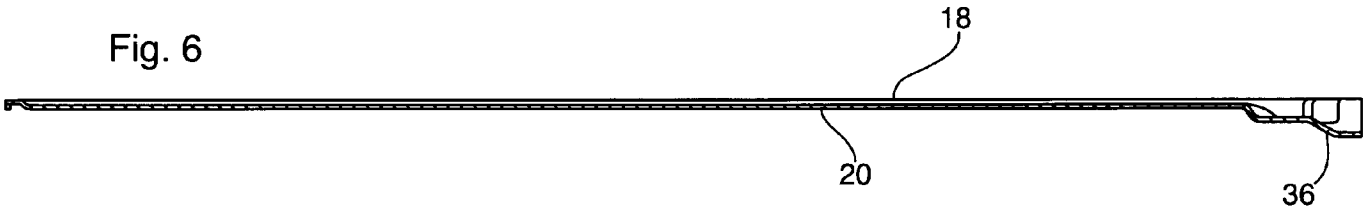
FIG. 6 is a longitudinal cross-section along line 6-6' of FIG. 5.
Figure 9:
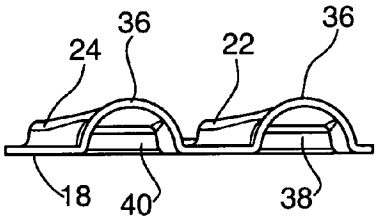
FIG. 9 is an end view of the heat exchanger plate of FIG. 5, showing the fitting end.
Figure 8:
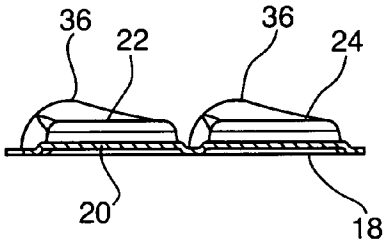
FIG. 8 is a transverse cross-section along line 8-8' of FIG. 5.
Figure 7:
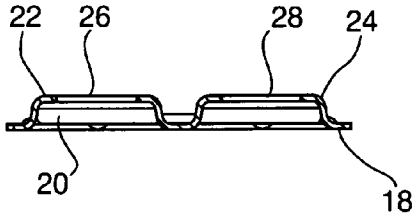
FIG. 7 is a transverse cross-section along line 7-7' of FIG. 5.
Figure 10A:
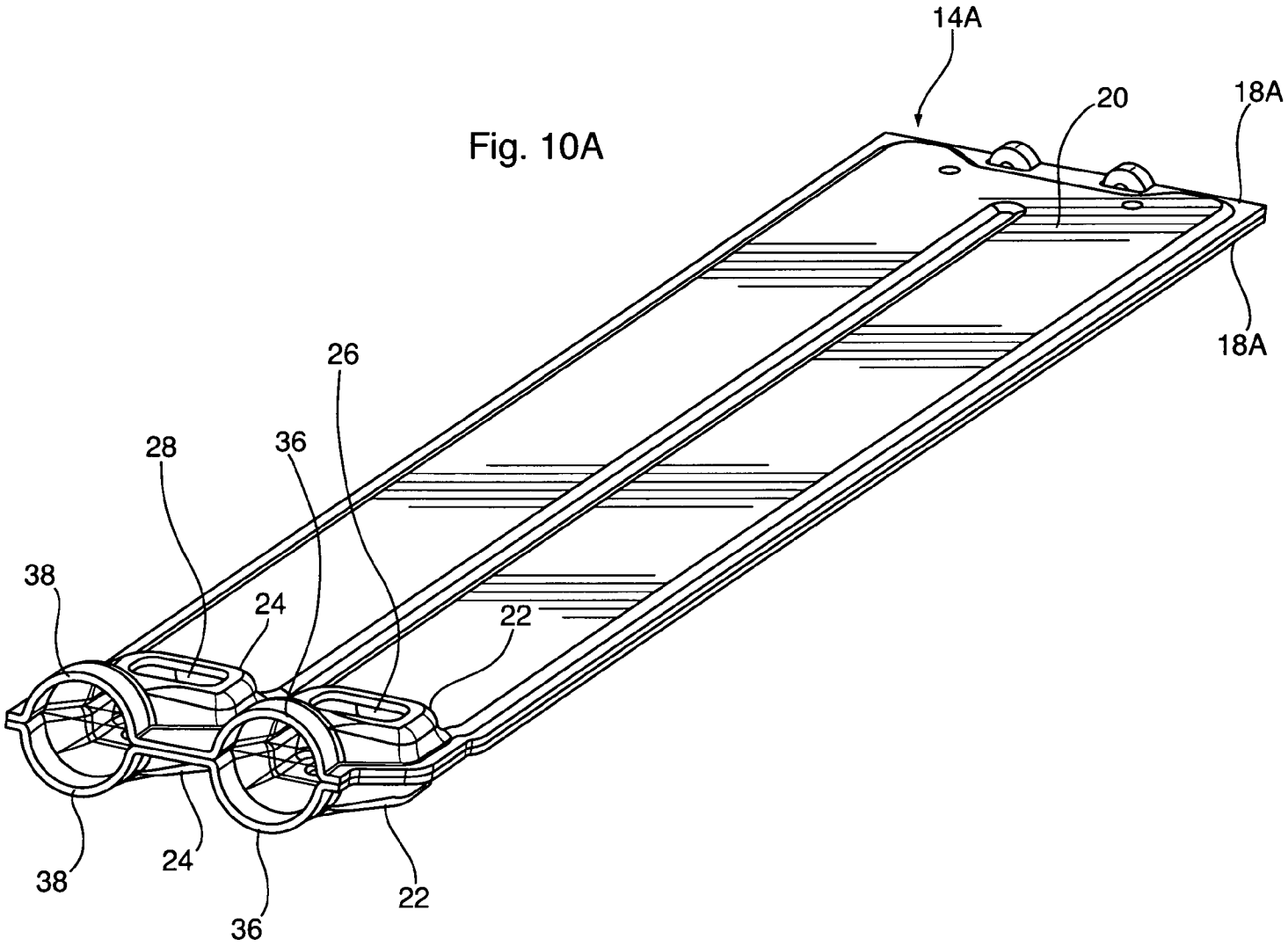
FIG. 10A is a perspective view of the central plate pair of the heat exchanger of FIG. 1.
Figure 10B:
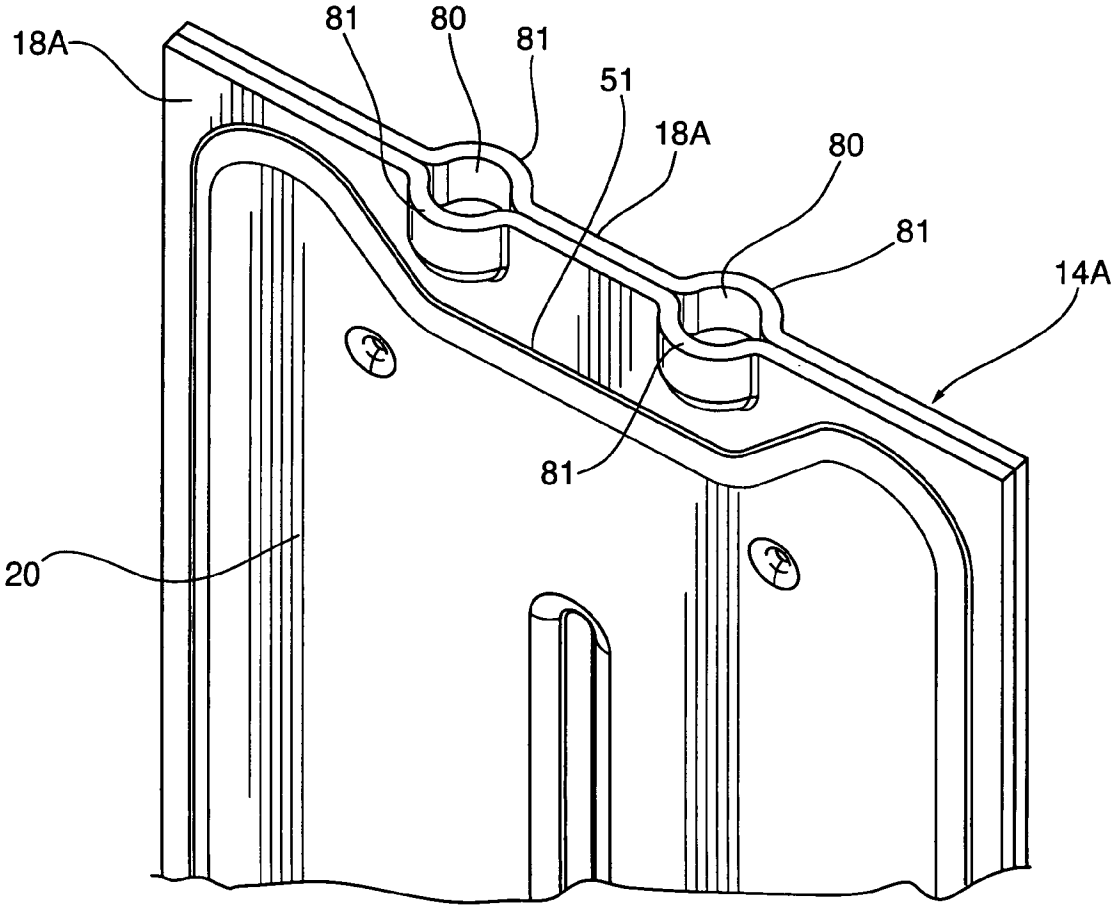
FIG. 10B is a close-up at one end of the central plate pair.
Figure 10C:
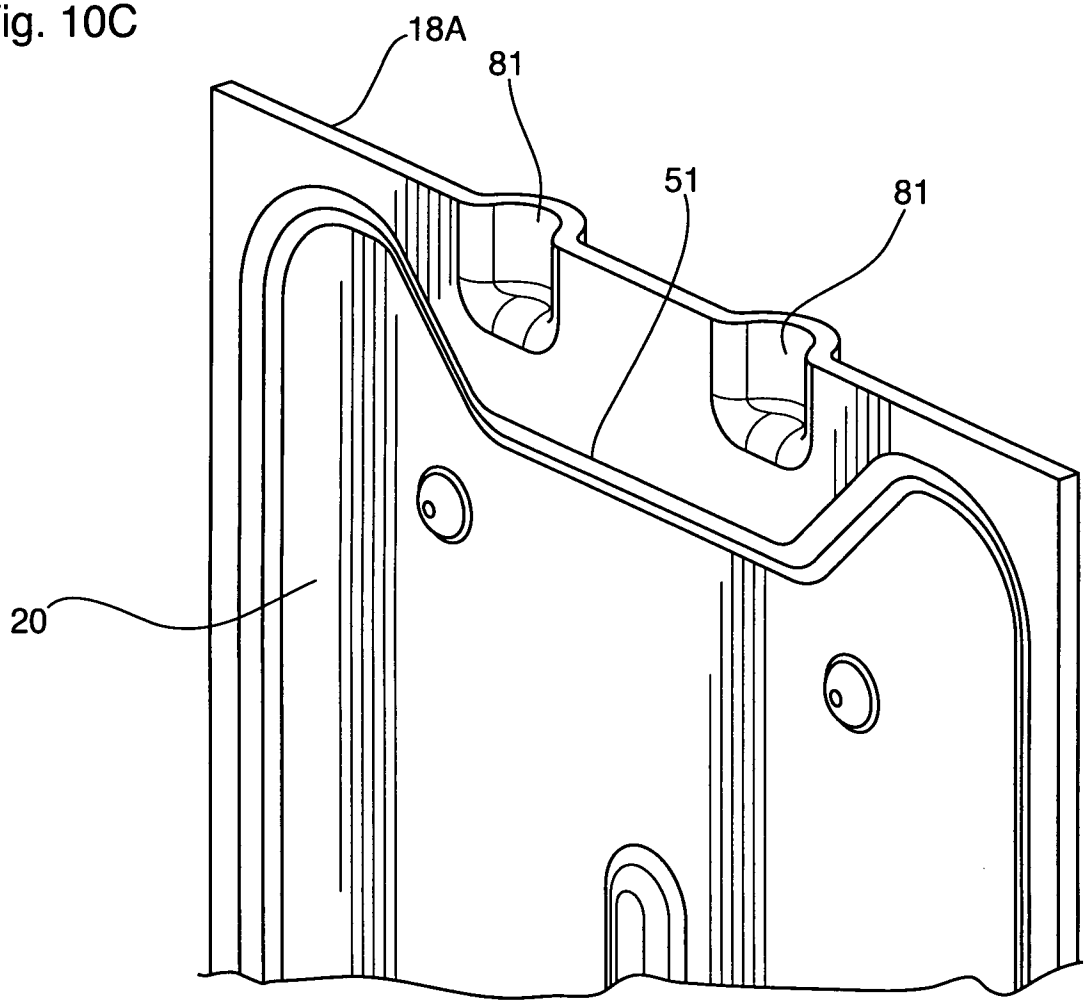
FIG. 10C is a close-up at one end of a plate making up the central plate pair.

The outer surface of each grommet 70 may be grooved at 76 to receive the edges of the apertures 68 in the end mounting bracket 58. This prevents the grommets 70 from becoming displaced from the apertures 64, and assists in alignment of the end bracket. The groove 76 divides the grommet 70 into an inner portion which extends from the aperture 64 toward the heat exchanger core 12, and an outer portion which extends from the aperture 64 away from the core 12. In the side view of FIG. 3, the inner portions of grommets 70 are shown as being in contact with the edge of a plate pair 14 of the heat exchanger core 12. It will be appreciated that this is not necessarily the case. Rather, a small clearance gap may be provided between the grommet 70 and the heat exchanger core 12. Furthermore, as shown in the side view, the vertical plate portion 60 of the end mounting bracket 58 may be "stepped" away from the core by provision of a shoulder 78, so as to provide sufficient clearance for the grommets 70.

The grommets 70 are made of a resilient material such as rubber. As they are primarily for permitting longitudinal expansion of the plate pairs 14, they are of a relatively high durometer hardness. It will be appreciated, however, that the resilient nature of the grommets 70 may also provide some benefits in terms of vibration reduction.

Although the illustrated embodiment utilizes grommets 70 to provide a resilient connection between projections such as pins 66 and the end mounting bracket 58, it will be appreciated that this is not necessarily the case. Rather, it will be appreciated that the resilient connection may be provided by substituting grommets 70 with simple plastic sleeves or bushings which surround the end of the pins 66 or other projection, and which isolate the pins 66 from the end mounting bracket 58. The bushings 66 may be similar in appearance to grommets 70, but may lack the rib on the inner surface. For example, each of the pins 66 may be closely received in a bushing and retained therein by a simple friction fit, such that the pin may be longitudinally slidable within the bushing by a small amount in response to thermal expansion of the heat exchanger. Thus, the term "resilient connection" as referred to herein refers to a connection whereby the pins are isolated from metal-to-metal contact by a resilient member such as a grommet, which may be compressible or deformable. Alternately, a resilient connection can also be provided by a non-deformable, non-compressible member such as a plastic bushing which permits a small amount of longitudinal sliding of the pin. Rather than using a plastic sleeve or bushing received in a metal mounting bracket to provide the resilient connection, it is possible to manufacture the entire mounting bracket from a rigid plastic material, in which case no separate bushing is required to line the apertures. In this case, the bushing is essentially integrally formed as part of the mounting bracket.

The bracket mounting pins 66 are rigidly attached to the heat exchanger core 12 and protrude therefrom by a sufficient distance to extend through the apertures 64 in the end mounting bracket 58. The rigid attachment of the pins 66 to the core 12 can be accomplished in numerous ways. In the plate and fin type heat exchanger 10 according to this embodiment, each of the pins 66 protrudes from an edge of the plate pair 14A. The pins 66 in this embodiment have a diameter which is greater than the edge thickness of the plate pairs 14, and several options are available for mounting the pins 66.

As shown in FIGS. 10B to 12, the raised portions of the plates 18 defining the coolant flow passages 20 may be cut back at 51, away from the end of the plates 18, so as to provide sufficient area for brazing and sealing of the plates 18 in the area surrounding the pins 66. The edge of plate pair 14A is provided with pin apertures 80 which are sized to closely receive the pins 66. These apertures 80 have a similar appearance as the inlet and outlet openings 38, 40 at the fitting end 34 of the plate pair 14A, except of course that they do not communicate with the coolant flow passage 20. The apertures 80 may be formed by a clamshell arrangement whereby each plate 18A of the plate pair 14A has a semi-circular bulge 81 at its edge to form one-half of a pin aperture 80.

In the illustrated embodiment, both pin apertures 80 are located in the edge of a single plate pair 14A. It will, however, be appreciated that one or more of such pin apertures 80 may be located in different plate pairs 14 in the core. The number and location of the pin apertures 80 and the number of pins 66 in the core 12 will depend at least partly on the height of the core 12, and on the configuration of the end mounting bracket 58.

In the illustrated embodiment, both of the pin apertures 80 are located in a plate pair 14A which is centrally located in the core 12, and which is the same plate pair 14A in which the inlet and outlet openings 38, 40 are provided. This arrangement may provide cost benefits in that it minimizes the number of special plate pairs 14 which are required in the core 12. Also, the plate pair 14A having the inlet and outlet openings 38, 40 may be thicker than the other plate pairs 14, and this additional thickness may provide better support for the pins 66. It will, however, be appreciated that it is not necessary that the plate pair 14A is thicker than the other plate pairs 14.

Figure 2:
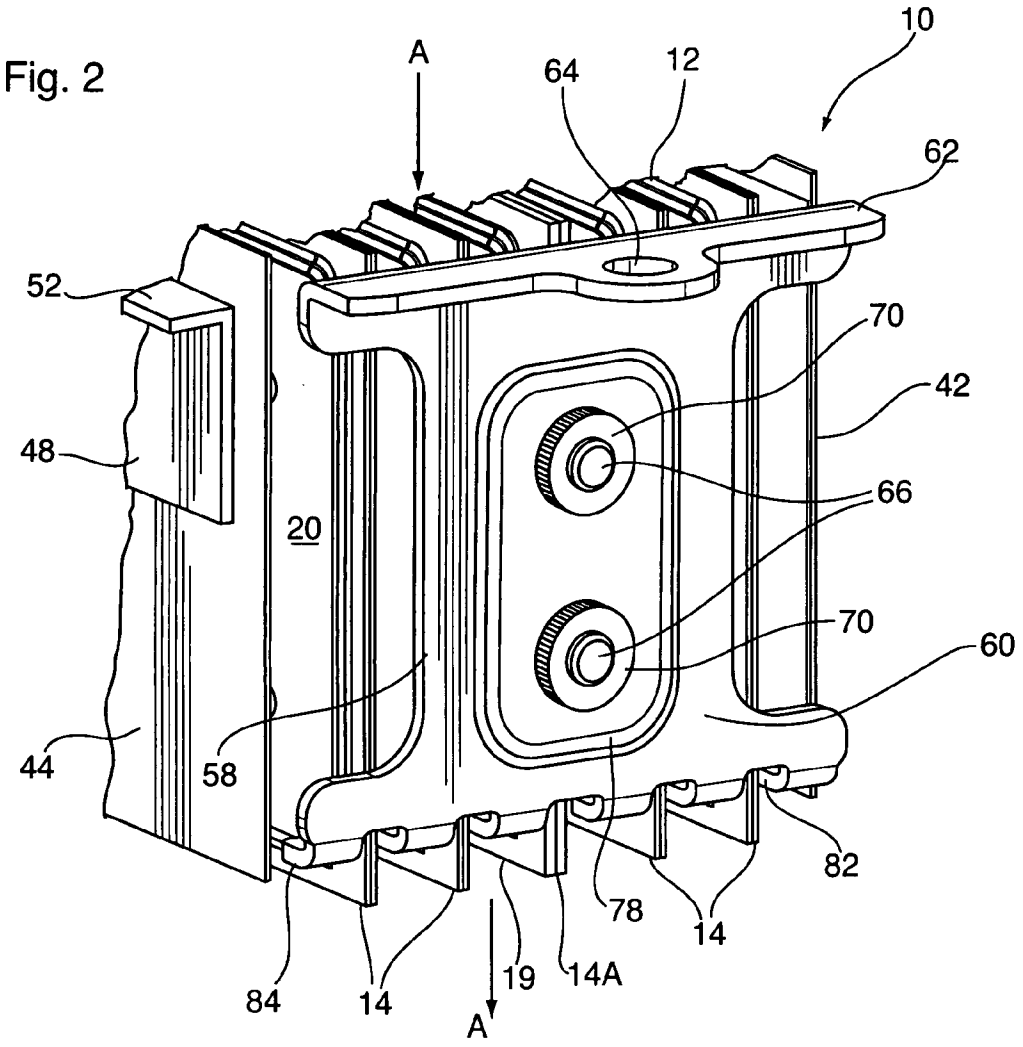
FIG. 2 is an enlarged view of an end of the heat exchanger shown in FIG. 1A.

In the orientation of the heat exchanger 10 shown in FIG. 2, the direction of air flow through air flow passages 19 is downward through the heat exchanger 10, in a direction of arrows A, i.e. transverse to the lengths of the plate pairs 14. Although not shown, it will be appreciated that the housing has at least one inlet opening for relatively hot air, and at least one outlet opening for cooled air. As mentioned above, cooling fins (not shown) are provided between adjacent plate pairs. However, the cooling fins cover only the areas of the plate pairs 14 in which the coolant flow passages 20 are provided, and do not extend to the edges of the plate pairs 14. Thus, hot air can bypass the cooling fins at the end of the heat exchanger 10, in the area where the plates 18 are joined together and extend out toward the end mounting bracket 58. In order to minimize the bypass flow at the end of the heat exchanger 10, the bottom edge of the end mounting bracket 58 may be provided with a comb arrangement 82. As shown, the bottom edge of the end mounting bracket 58 is bent inwardly toward the core 12 at an angle of about 90°. This bent edge is divided into a plurality of teeth 84, each of which extends into the space between the edges of two adjacent plate pairs 14.

It will be appreciated that the comb arrangement 82 of the end mounting bracket 58 may provide some amount of support to the bracket 58, and therefore it may be possible to eliminate one of the two bracket mounting pins 66 at the end of the core 12.

Figure 11:
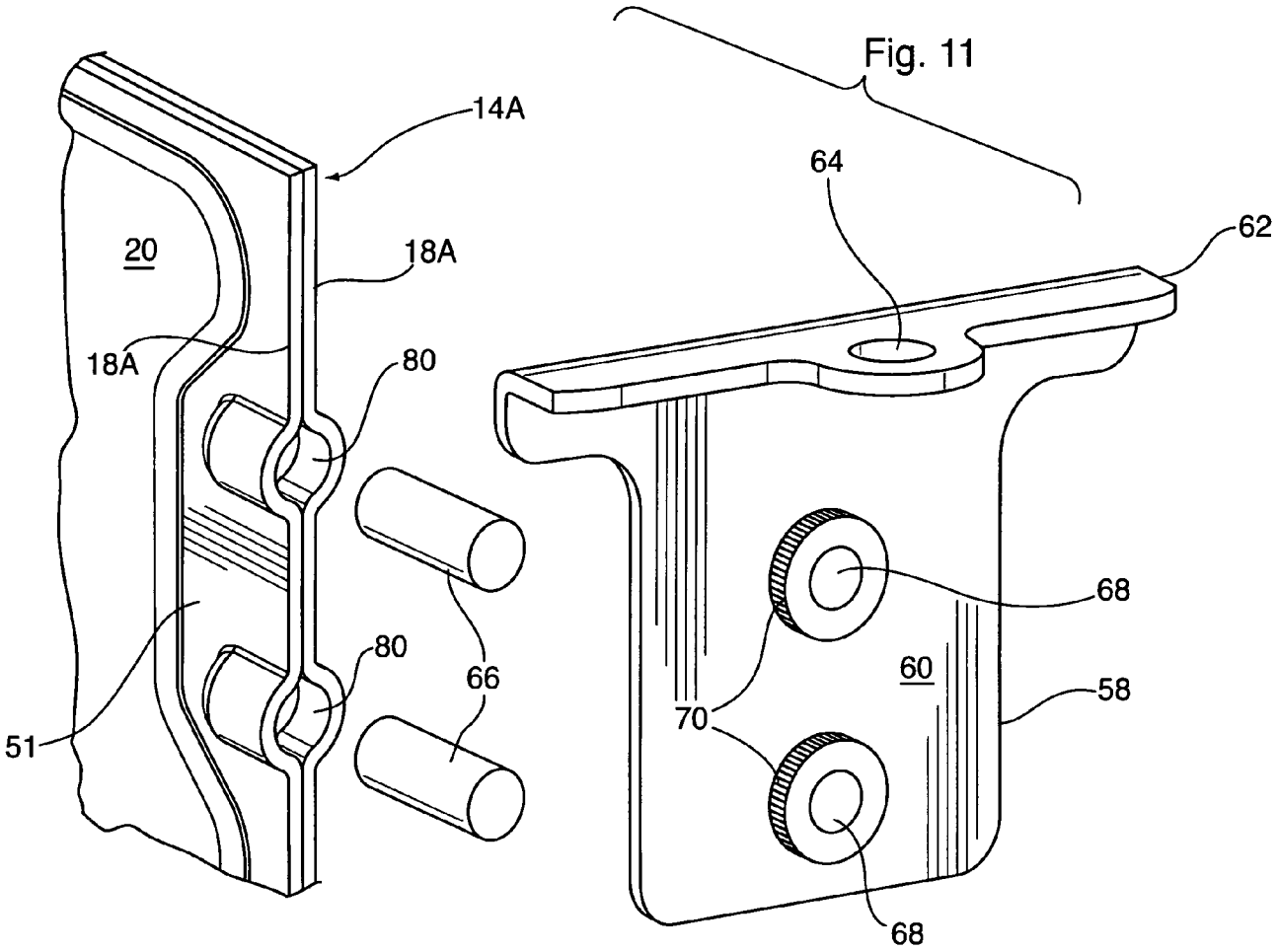
FIG. 11 is an exploded, partial view of a heat exchanger according to another embodiment of the invention, showing an end of a plate pair in relation to a resilient end bracket mounting arrangement.
Figures 12, 13:
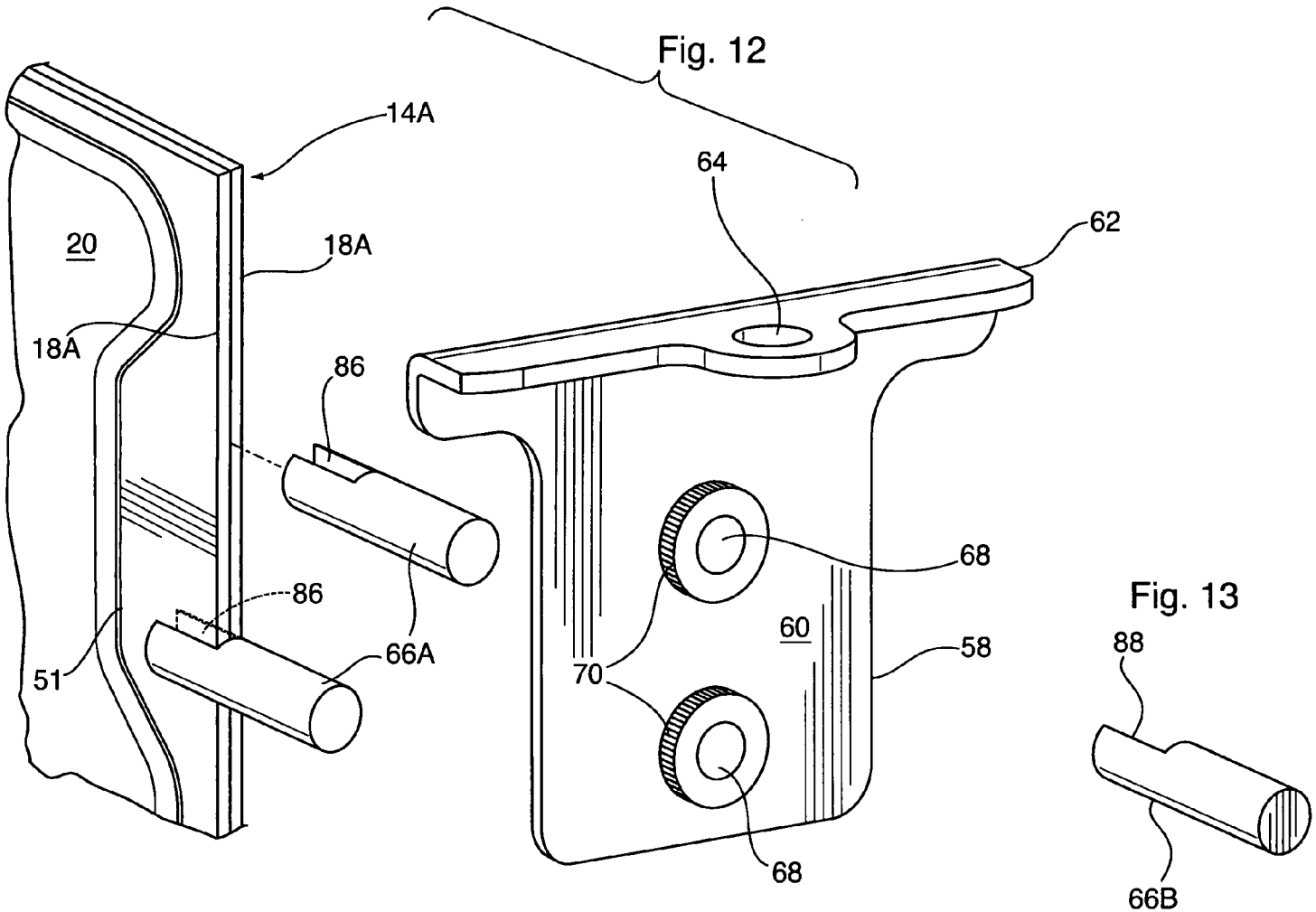
FIG. 12 is an exploded, partial view of a heat exchanger according to yet another embodiment of the invention, showing an end of a plate pair in relation to a resilient end bracket mounting arrangement.
FIG. 13 is a view of an alternate pin configuration for use in the embodiment illustrated in FIG. 12.
Figure 14:
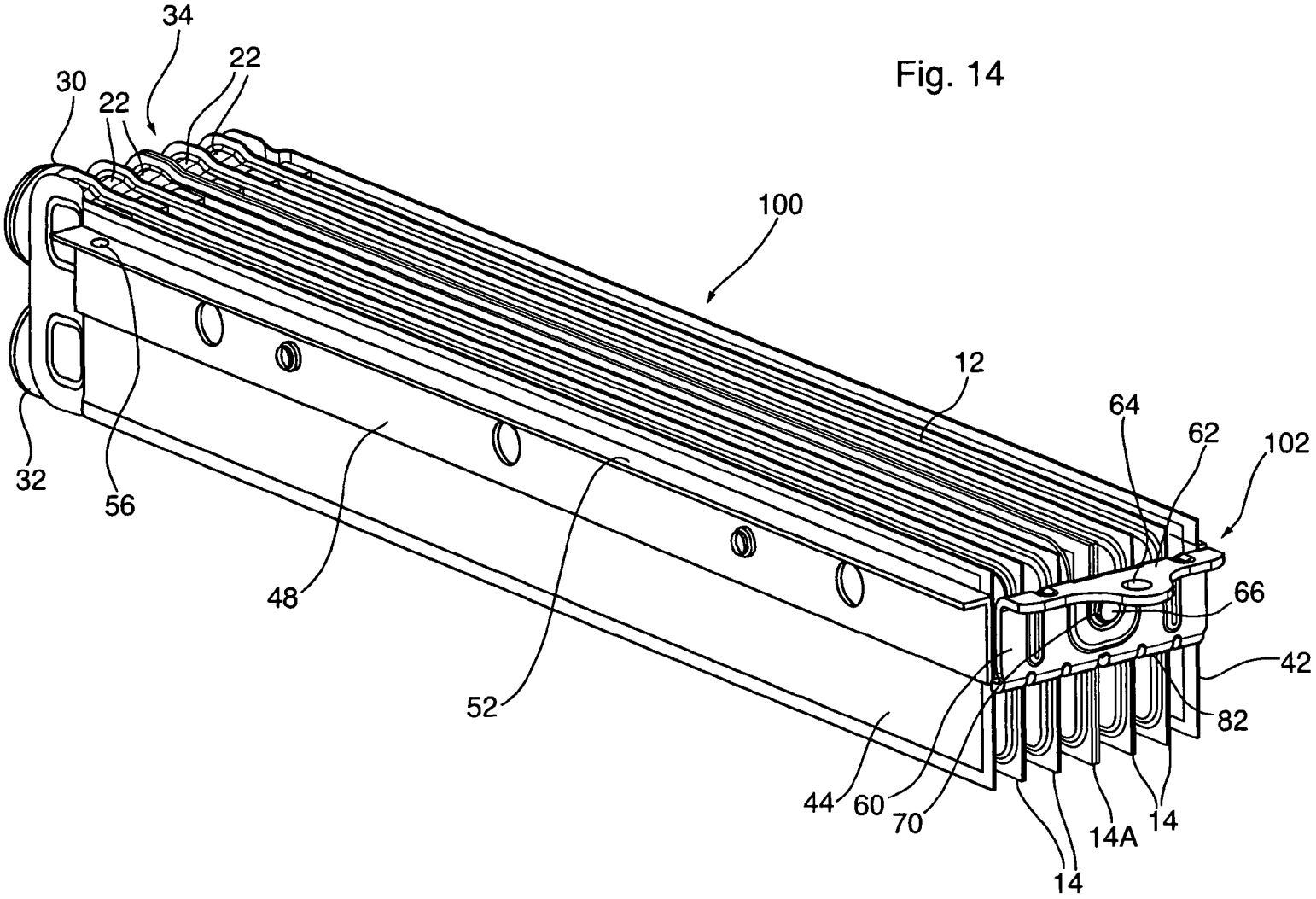
FIG. 14 is a perspective view of a heat exchanger according to a further embodiment of the invention.

Some alternate embodiments of the invention are illustrated in FIGS. 11-13. FIG. 11 illustrates a portion of a heat exchanger 10, as described above (with only one plate pair 14A being shown for simplicity), wherein the end mounting bracket 58 does not include a comb arrangement.

FIG. 12 illustrates an alternate embodiment similar to that illustrated in FIG. 11 except that the edge of the plate pair 14A does not include pin apertures 80, and the pins 66A instead are provided with slots 86 in which the edges of the plate pair 14 are received in clothespin fashion. FIG. 13 illustrates an alternate form of pin 66B in which a cutout 88 is formed on one side so as to provide the pin 66B with a flat face by which it can be joined to an edge of the plate pair 14, for example by brazing.

A heat exchanger 100 according to a further embodiment of the invention is now described below with reference to FIGS. 14 to 17. Heat exchanger 100 shares many of the same elements as the embodiments 10 described above, and these elements are identified in the following description and the drawings with like reference numerals. Therefore, the above description of these elements in heat exchanger 10 applies equally to the present embodiment, and the following description is limited to the differences between heat exchanger 10 and heat exchanger 100.

The only significant difference between heat exchanger 100 and heat exchanger 10 is in the end bracket mounting arrangement, which includes an end mounting bracket 102. More specifically, the end bracket mounting arrangement of heat exchanger 100 includes only one mounting pin 66 rather than the two pins 66 of heat exchanger 10. Accordingly, the end mounting bracket 102 includes a vertical plate portion 60 which is mounted to the heat exchanger core 12. At the upper edge of the plate portion 60 is an outwardly extending flange 62 having an aperture 64 through which the end mounting bracket 102 is rigidly secured to the housing by a fastener such as a bolt (not shown). The end mounting bracket according to this embodiment is typically made from metal.

Figure 15:
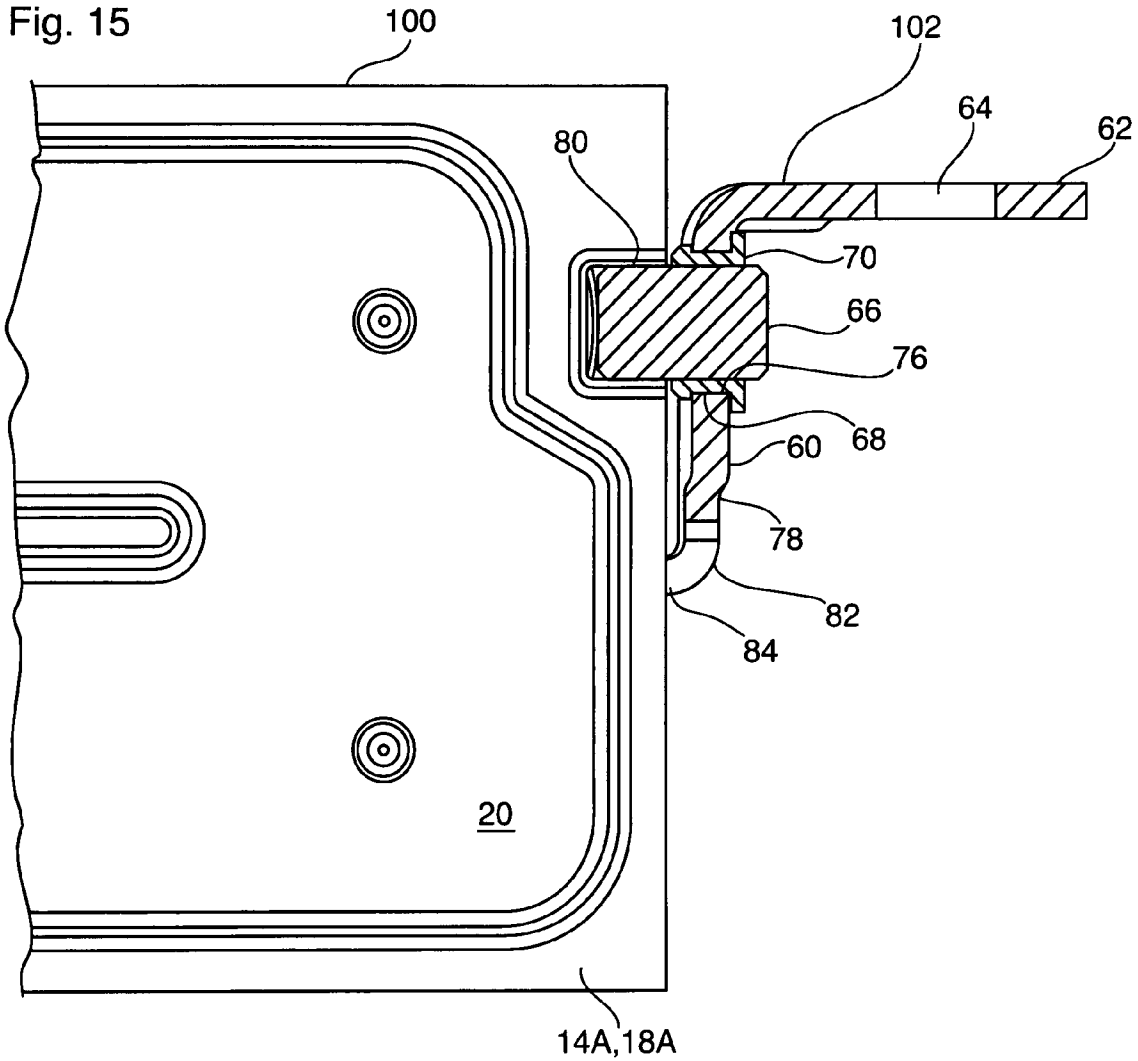
FIG. 15 is an enlarged, partial cross-section through the heat exchanger of FIG. 14, the section being taken along a longitudinal plane bisecting the end mounting bracket and its mounting arrangement.
Figure 16:
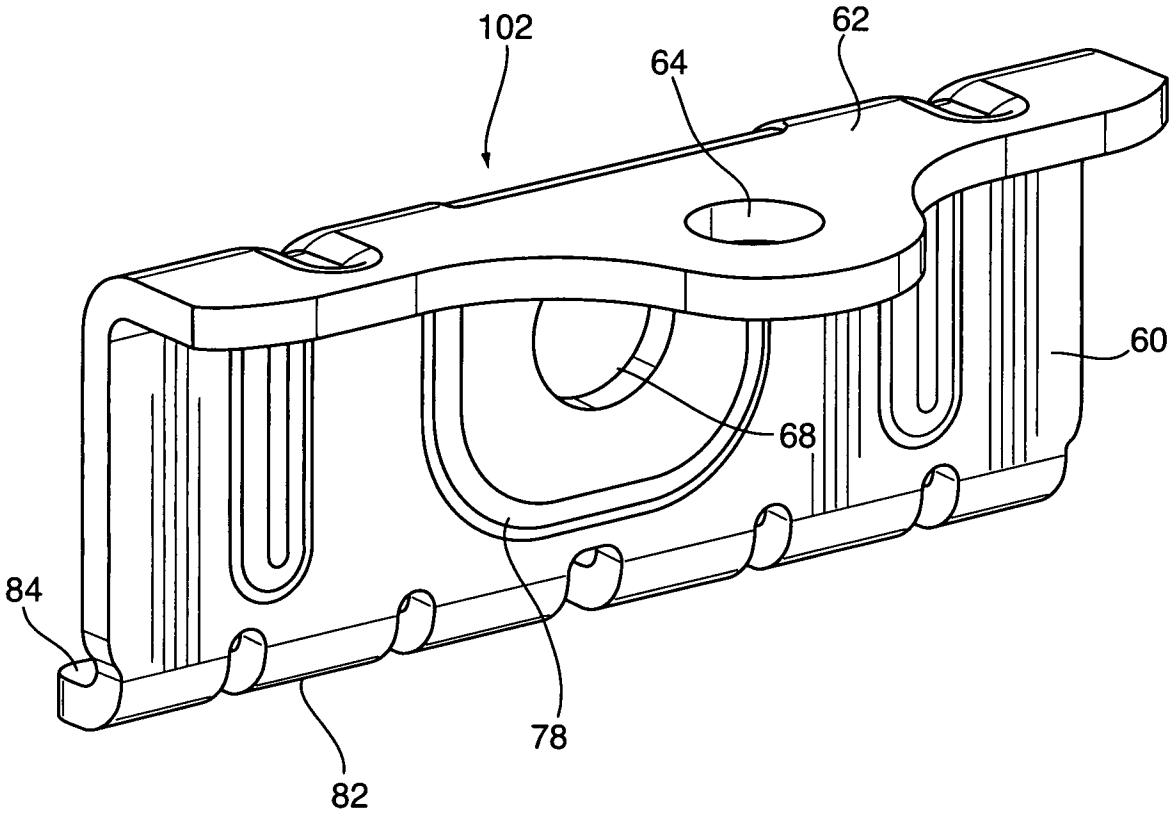
FIG. 16 is a front perspective view of the mounting bracket of the heat exchanger of FIG. 14.
Figure 17:
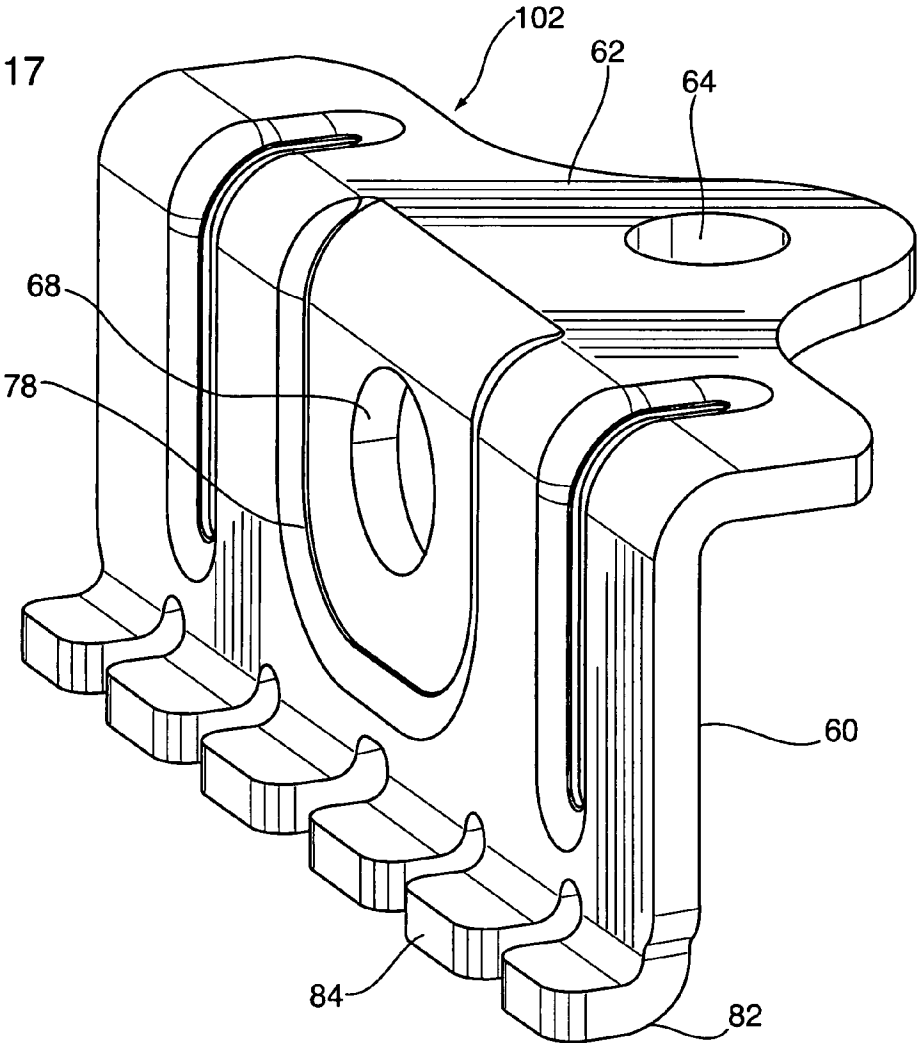
FIG. 17 is a rear perspective view of the mounting bracket of the heat exchanger of FIG. 14.
Figure 18:
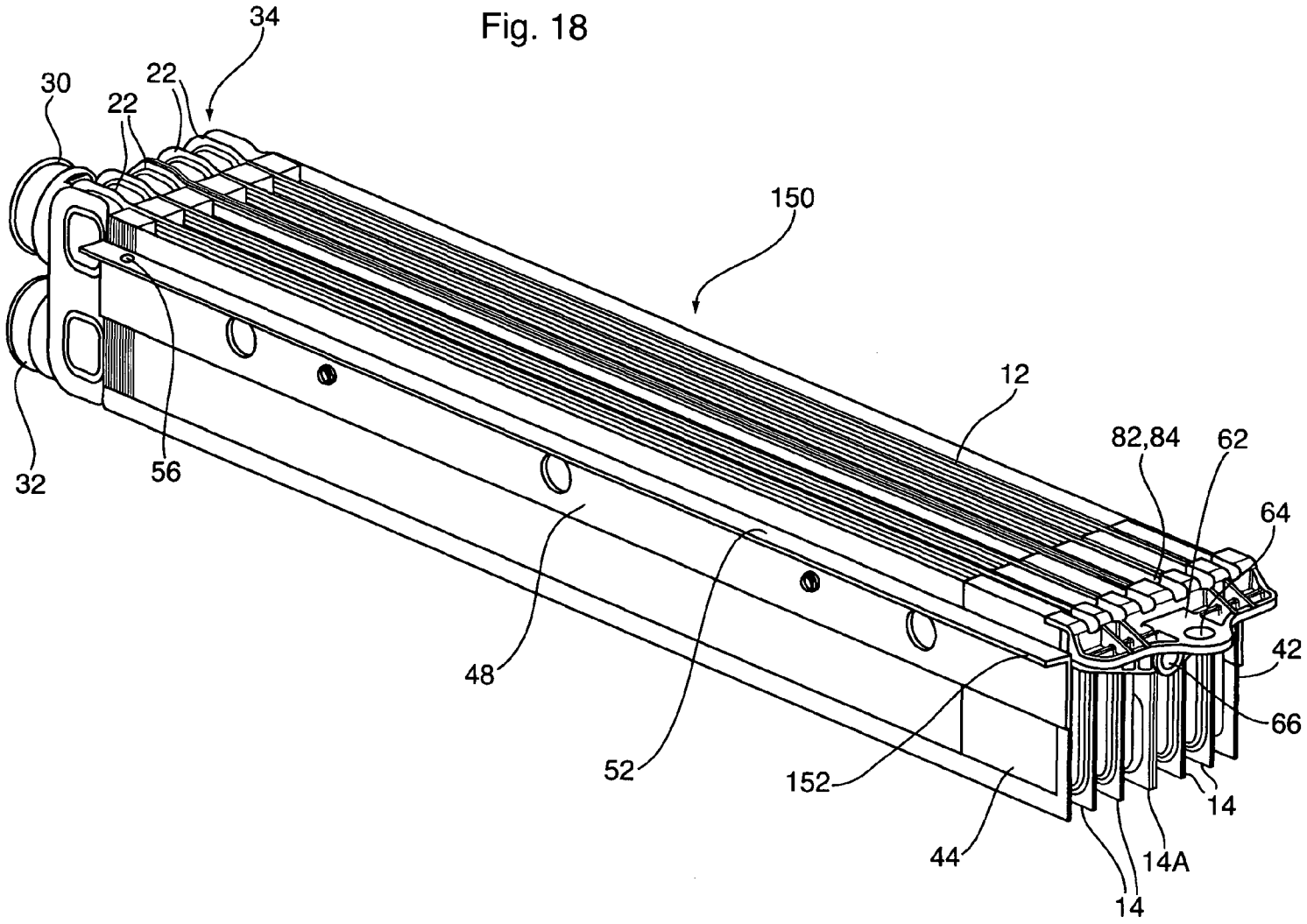
FIG. 18 is a perspective view of a heat exchanger according to a further embodiment of the invention.

The bracket mounting pin 66 is rigidly secured to the heat exchanger core 12 in the manner described above. As shown in FIG. 15, the edge of plate pair 14A is provided with a single pin aperture 80 which is sized to closely receive one end of the pin 66, with the pin 66 being secured within aperture 80, for example by brazing. The other end of pin 66 extends into an aperture 68 provided in the plate portion 60 of the end mounting bracket 102. Although FIGS. 14 to 17 show a particular arrangement for attaching pin 66 to heat exchanger core 12, it will be appreciated that the pin can be fastened by any of the alternate methods described above, including those shown in FIGS. 12 and 13.

The mounting arrangement further comprises a grommet 70 received in aperture 68 and surrounding the bracket mounting pin 66. The grommets 70 are annular, having a substantially cylindrical inner surface and a substantially cylindrical outer surface. Although not shown in the drawings, the inner surface of grommet 70 may be provided with an annular rib which seats inside an annular groove (not shown) provided in the bracket mounting pin 66.

The outer surface of grommet 70 is grooved at 76 to receive the edges of the aperture 68, with the groove 76 divides the grommet 70 into an inner portion which extends from the aperture 64 toward the heat exchanger core 12, and an outer portion which extends from the aperture 64 away from the core 12. In the side view of FIG. 15, the inner portion of grommet 70 is spaced from the heat exchanger core 12, and the vertical plate portion 60 of bracket 102 is stepped away from the core 12 by a shoulder 78, so as to provide clearance for the grommet 70.

The bottom edge of the end mounting bracket 102 may be provided with a comb arrangement 82. As shown in the drawings, the bottom edge of the end mounting bracket 102 is bent inwardly toward the core 12 at an angle of about 90°. This bent edge is divided into a plurality of teeth 84, each of which extends into the space between the edges of two adjacent plate pairs 14.

A heat exchanger 150 according to a further embodiment of the invention is now described below with reference to FIGS. 18 to 21. Heat exchanger 150 shares many of the same elements as heat exchangers 10 and 100 described above, and these elements are identified in the following description and the drawings with like reference numerals. Therefore, the above description of these elements in heat exchangers 10 and 100 applies equally to the present embodiment, and the following description is limited to the differences between heat exchanger 150 and heat exchangers 10 and 100.

The only significant difference between heat exchanger 150 and heat exchangers 10 and 100 is in the end bracket mounting arrangement, which includes an end mounting bracket 152. As in the heat exchanger 100, the present embodiment utilizes only one mounting pin 66 rather than the two pins 66 of heat exchanger 10. Accordingly, the end mounting bracket 152 includes a vertical plate portion 60 which is mounted to the heat exchanger core 12. At the upper edge of the plate portion 60 is an outwardly extending flange 62 having an aperture 64 through which the end mounting bracket 152 is rigidly secured to the housing by a fastener such as a bolt (not shown).

Figure 19:
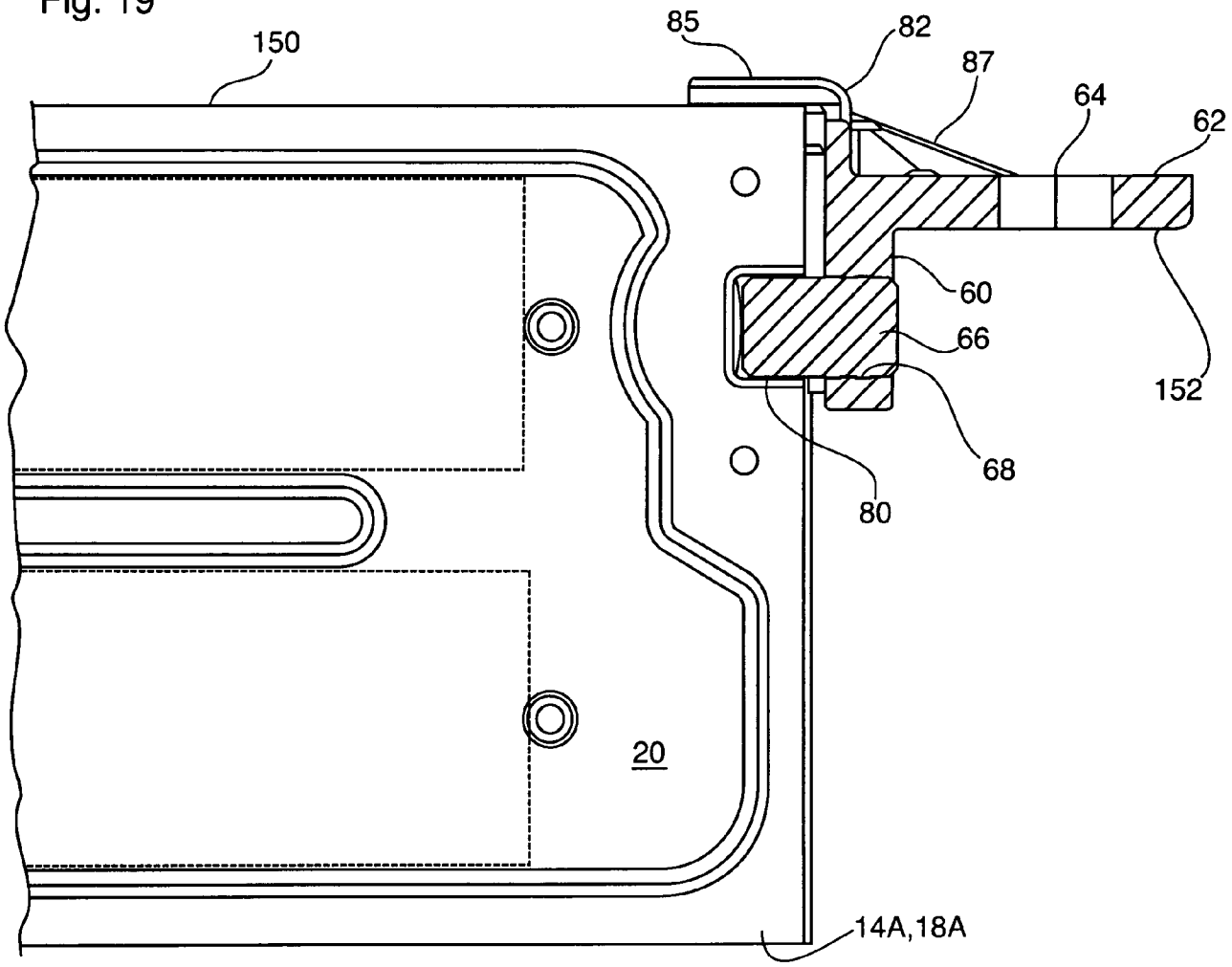
FIG. 19 is an enlarged, partial cross-section through the heat exchanger of FIG. 18, the section being taken along a longitudinal plane bisecting the end mounting bracket and its mounting arrangement.
Figure 20:
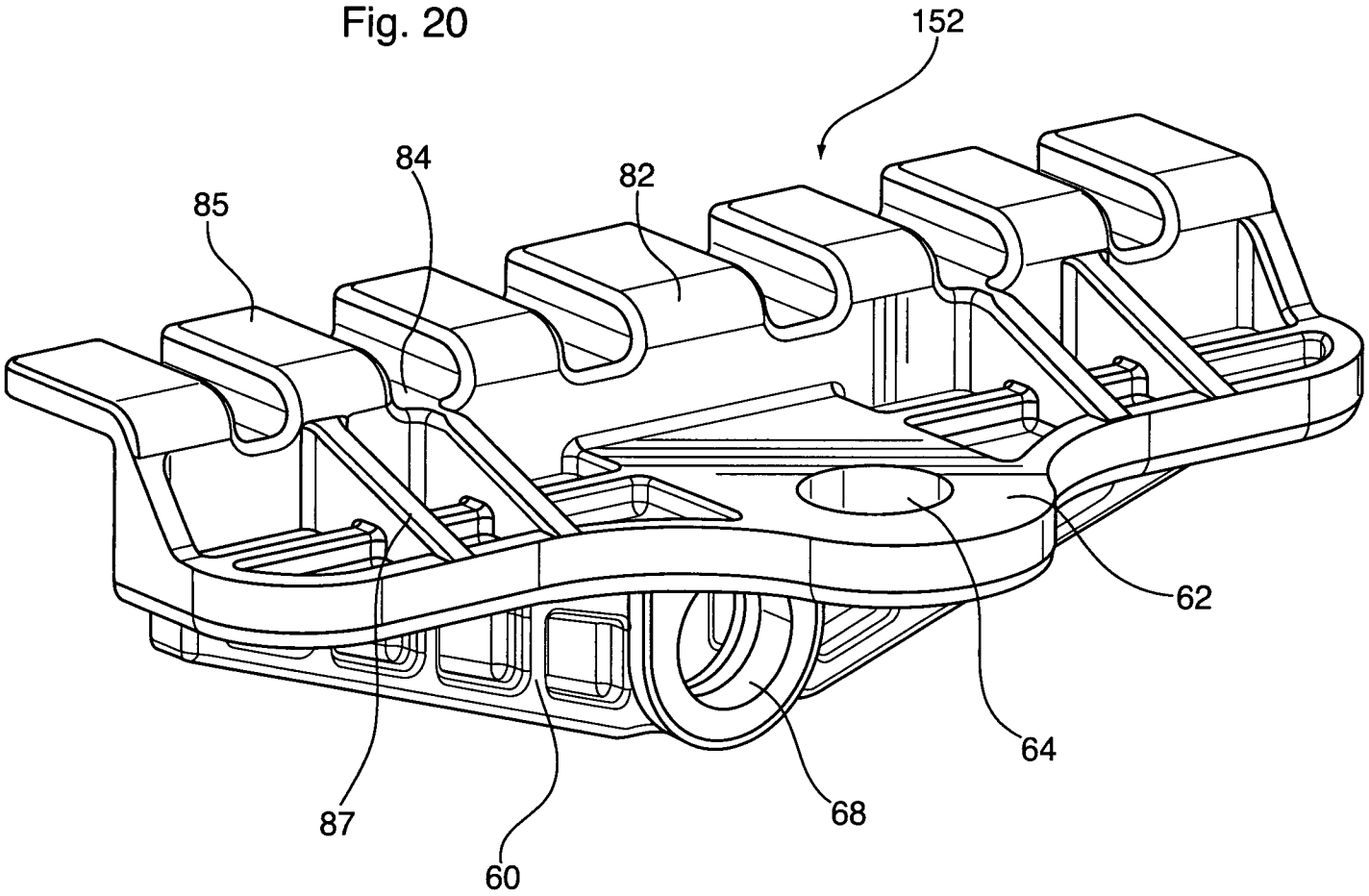
FIG. 20 is a front perspective view of the mounting bracket of the heat exchanger of FIG. 18.
Figure 21:
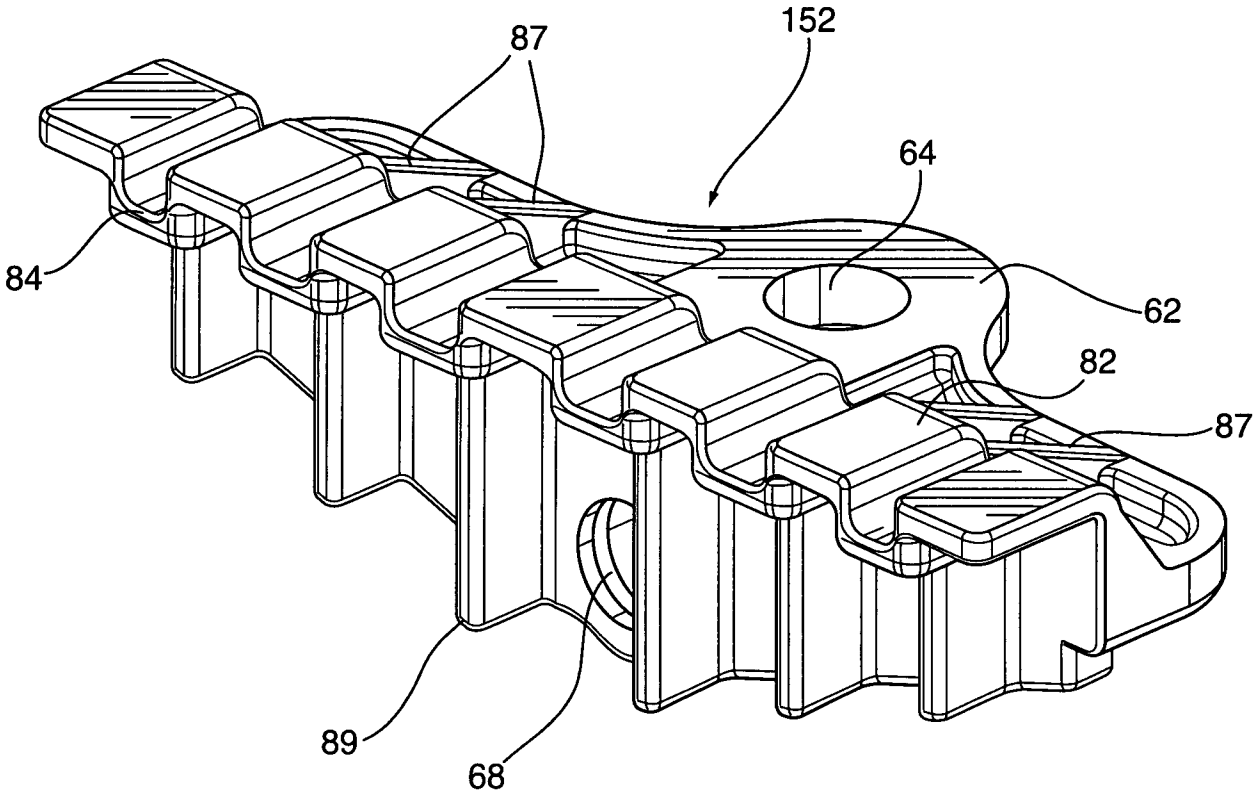
FIG. 21 is a rear perspective view of the mounting bracket of the heat exchanger of FIG. 18.

The bracket mounting pin 66 is rigidly secured to the heat exchanger core 12 in the manner described above. As shown in FIG. 19, the edge of plate pair 14A is provided with a single pin aperture 80 which is sized to closely receive one end of the pin 66, with the pin 66 being secured within aperture 80, for example by brazing. The other end of pin 66 extends into an aperture 68 provided in the plate portion 60 of the end mounting bracket 152. Although FIGS. 18 to 21 show a particular arrangement for attaching pin 66 to heat exchanger core 12, it will be appreciated that the pin can be fastened by any of the alternate methods described above, including those shown in FIGS. 12 and 13.

The end mounting bracket 152 is typically made from a rigid, heat-resistant plastic. Due to the inherent resilience of the plastic material comprising bracket 152, there is no need to provide a grommet in the aperture 68.

The upper edge of the end mounting bracket 152 is molded to extend backwards from flange 62, thereby providing a comb arrangement 82 to reduce bypass air flow. As shown in the drawings, the upper edge of the end mounting bracket 152 is bent inwardly toward the core 12 at an angle of about 90° . This comb arrangement 82 includes a plurality of teeth 84, each of which extends into the space between the edges of two adjacent plate pairs 14. The comb further includes a plurality of ribs 85 which join the teeth 84 together, thereby enhancing rigidity of the bracket 152 and further enhancing the bypass blocking effect. It will be seen that the bracket 152 is also with a plurality of ribs 87 and 89 along its front and rear surfaces to enhance rigidity.

It will be appreciated that the end mounting bracket 152 may be modified to have more than one aperture 68 in cases where more than one pin 66 is mounted to the heat exchanger core 12.

Figure 22B:
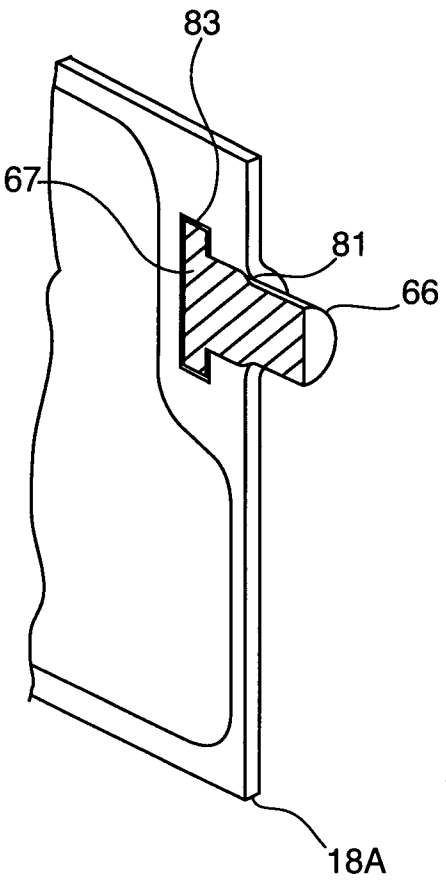
FIGS. 22A and 22B are views showing an alternate pin mounting arrangement.
Figure 22A:
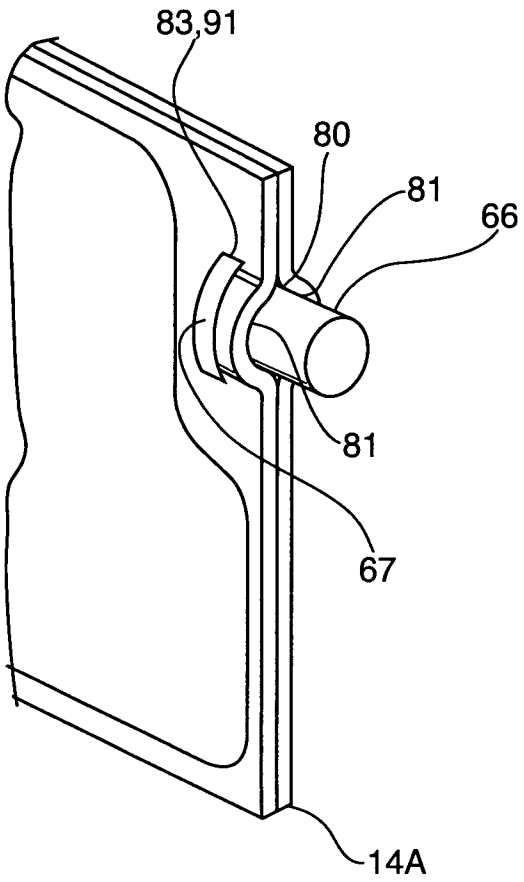

FIGS. 22A and 22B illustrate an alternate arrangement for mounting a pin 66 to a plate pair 14A. The pin mounting arrangement of FIG. 22 is identical to that shown in FIG. 19 except that each of the bulges 81 making up the pin aperture 80 is provided with an open slot 83 at its base (opposite the open end at the edge of plate 18A), the slot 83 comprising a rectangular opening through the plate 18A. The slots 83 in each plate 18A combine to form an open space 91 at the base of the aperture 80 (opposite the open end at the edge of plate 18A) which is sized to accept an enlarged head 67 provided at one end of pin 66, the head 67 having a diameter greater than the diameter of the pin aperture 80. In FIG. 22A the head 67 of pin 66 can be seen through the slot 83. The pin 66 may be secured to the plate pair 14A by brazing, as in the embodiments described above, but the head 67 provides additional pull-out resistance because the head 67 of pin 66 is larger than the pin aperture 80.

Although the pin mounting arrangement shown in FIG. 22 is adapted for use with an end mounting bracket having a single aperture 68, it will be appreciated that the pin mounting arrangement of FIG. 22 can be used with any of the heat exchangers 10, 100, 150 described above.

Although the invention has been described in connection with certain embodiments, it is not limited thereto. Rather, the invention includes all embodiments which may fall within the scope of the following claims.

What is claimed is:

1. A heat exchanger comprising:

(a) a heat exchanger core comprising a plurality of plate pairs arranged in a stack, wherein each said plate pair defines an elongate flow passage defining a longitudinal axis, the heat exchanger core having a first end and a second end spaced apart along the longitudinal axis;

(b) a first mounting arrangement at the first end of the heat exchanger core for attaching the heat exchanger core to a support structure;

(c) a second mounting arrangement at the second end of the heat exchanger core for attaching the heat exchanger core to the support structure, wherein the first and second mounting arrangements are spaced apart along the longitudinal axis, and wherein the second mounting arrangement comprises:

(i) a mounting bracket having a first portion for attachment to the support structure and a second portion through which the mounting bracket is attached to the heat exchanger core;

(ii) at least one aperture provided in the second portion of the mounting bracket;

(iii) at least one projection rigidly attached to the heat exchanger core and projecting from the second end thereof, each said projection attached to the second portion of the mounting bracket by a resilient connection and with its first end received in one of said apertures;

wherein each said plate pair comprising a pair of plates joined together in face-to-face relation at peripheral edges of the plate pair, wherein one of said flow passages are defined inward of the peripheral edges, between the plates of each said plate pair, and wherein each of said projections extends along said axis from one of said peripheral edges of one of said plate pairs at the second end of the heat exchanger core;

wherein said second mounting arrangement further comprises at least one plastic bushing, wherein each said bushing surrounds an inner edge of one of said apertures and has an interior surface sized to closely receive one of said projections, such that each said bushing provides said resilient connection between one of said projections and the second portion of the mounting bracket;

wherein each of said projections is retained within one of said bushings by a friction fit, such that the projection is longitudinally slidable within the bushing in response to longitudinal thermal expansion of the heat exchanger; and wherein the second portion of the mounting bracket is spaced from the peripheral edges of the plate pairs at the second end of the heat exchanger core, with a clearance gap being provided between each said bushing and the peripheral edges of the plate pairs at the second end of the heat exchanger core, wherein each said clearance gap is defined by an empty space between one of said bushings and said one of said peripheral edges from which each of said projections extends, and wherein said clearance gap extends radially outwardly from an inner edge of the aperture which is surrounded by said bushing.

2. The heat exchanger of claim 1, wherein the heat exchanger is a gas-liquid heat exchanger and wherein said flow passages are for flow of a liquid coolant.

3. The heat exchanger of claim 1, wherein the first portion of the mounting bracket comprises an apertured flange; and wherein the second portion of the mounting bracket comprises a plate portion which is oriented substantially transverse to the longitudinal axis and the projections are oriented substantially parallel to the longitudinal axis.

4. The heat exchanger of claim 3, wherein the first portion of the mounting bracket is located along an edge of the second portion, and projects therefrom at an angle of about 90 degrees away from said heat exchanger.

5. The heat exchanger of claim 1, wherein each of said projections comprises a pin which is rigidly secured to one of said peripheral edges of one of said plate pairs at the second end of the heat exchanger core.

6. The heat exchanger of claim 5, wherein each said peripheral edge to which one of said projections is secured is provided with an aperture into which a second end of the pin is received, said aperture being spaced from the flow passage.

7. The heat exchanger of claim 6, wherein each said aperture in the peripheral edge is formed by providing both plates of the plate pair with bulges which combine to form said aperture when the plates are joined together.

8. The heat exchanger of claim 6, wherein each said pin is substantially cylindrical and wherein said aperture in the peripheral edge is substantially cylindrical and is formed by two of said bulges having a substantially semi-circular cross section.

9. The heat exchanger of claim 8, wherein each said pin has an enlarged head having a diameter greater than a diameter of said aperture, wherein open slots are provided at a base of each of said bulges, said open slots forming an open space at a base of said aperture, and wherein said enlarged head is received in said open space at the base of the aperture.

10. The heat exchanger of claim 1, wherein the heat exchanger further comprises one inlet fitting and one outlet fitting, the fittings projecting from the first end of the heat exchanger core;

wherein the inlet and outlet fittings project from a first peripheral edge of one of said plate pairs; and wherein each of said projections extends from an opposite second peripheral edge of said one plate pair, and wherein said first and second peripheral edges are spaced apart along the longitudinal axis.

11. The heat exchanger of claim 1, wherein adjacent plate pairs are spaced apart from one another by cooling fins provided between the flow passages of adjacent plate pairs, and wherein gaps are formed between the peripheral edges of adjacent plate pairs, and wherein the mounting bracket of the second mounting arrangement further comprises a third portion comprising a comb arrangement, wherein the comb arrangement comprises a plurality of spaced-apart teeth, wherein each of the teeth extends into one of said gaps between two of said plate pairs.

12. The heat exchanger of claim 11, wherein said comb arrangement is located along an edge of the second portion of the mounting arrangement, and projects therefrom at an angle of about 90 degrees towards said heat exchanger.

13. The heat exchanger of claim 1, wherein said mounting bracket is comprised of a rigid plastic material and said plastic bushing is integrally formed as part of said mounting bracket.

14. The heat exchanger of claim 1, wherein each said plastic bushing is non-deformable and non-compressible.

* * * * *